US010897123B2

(12) United States Patent
Abe

(10) Patent No.: US 10,897,123 B2
(45) Date of Patent: Jan. 19, 2021

(54) SPARK PLUG FOR INTERNAL COMBUSTION ENGINE HAVING A SHAPED COMPOSITE CHIP ON CENTER ELECTRODE AND/OR GROUND ELECTRODE

(71) Applicant: DENSO CORPORATION, Kariya (JP)

(72) Inventor: Nobuo Abe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/844,236

(22) Filed: Apr. 9, 2020

(65) Prior Publication Data

US 2020/0259315 A1 Aug. 13, 2020

Related U.S. Application Data

(63) Continuation of application No. PCT/JP2018/038822, filed on Oct. 18, 2018.

(30) Foreign Application Priority Data

Oct. 19, 2017 (JP) ..... 2017-202589
Oct. 4, 2018 (JP) ..... 2018-189149

(51) Int. Cl.

| | |
|---|---|
| ***H01T 13/20*** | (2006.01) |
| ***H01T 13/32*** | (2006.01) |
| ***C22C 19/05*** | (2006.01) |
| ***H01T 13/39*** | (2006.01) |
| ***C22C 5/04*** | (2006.01) |

(52) U.S. Cl.
CPC ..... *H01T 13/39* (2013.01); *C22C 5/04* (2013.01); *C22C 19/058* (2013.01)

(58) Field of Classification Search
CPC ..... H01T 13/20; H01T 13/39; H01T 13/32; H01T 21/06; C22C 5/04; C22C 19/05
See application file for complete search history.

(56) References Cited

U.S. PATENT DOCUMENTS

| | | | | |
|---|---|---|---|---|
| 5,107,169 | A * | 4/1992 | Schneider | H01T 13/39 313/141 |
| 5,866,973 | A * | 2/1999 | Kagawa | H01T 13/39 313/141 |
| 8,946,976 | B2 * | 2/2015 | Kodama | H01T 13/20 313/141 |
| 2001/0030494 | A1 * | 10/2001 | Kanao | H01T 13/32 313/141 |
| 2017/0033539 | A1 | 2/2017 | Segawa et al. | |

FOREIGN PATENT DOCUMENTS

| | | |
|---|---|---|
| JP | 5545166 | 7/2014 |

* cited by examiner

*Primary Examiner* — Tracie Y Green
(74) *Attorney, Agent, or Firm* — Nixon & Vanderhye PC

(57) ABSTRACT

A spark plug includes a center electrode held inside an insulator, a ground electrode that is provided on a housing holding the insulator and faces the center electrode, and a composite chip formed on at least one of the electrodes. In the composite chip, a core having a mount integral with an electrode base material is formed from a Ni alloy material, and a surface layer having a discharge portion covering a protrusion end surface of the core and a side surface coating covering a side surface is formed from a Pt alloy material. The coating thickness S of the side surface coating in the radial direction, the outer diameter D1 of the discharge portion, and the coating length L1 of the side surface coating in the axial direction satisfy: S≥D1/20+L1/10−0.005 mm.

9 Claims, 20 Drawing Sheets

(EXPERIMENTAL EXAMPLE 1)

(EXPERIMENTAL EXAMPLE 2)

(EXPERIMENTAL EXAMPLE 3)

(EXPERIMENTAL EXAMPLE 4)

(EXPERIMENTAL EXAMPLE 5)

(EXPERIMENTAL EXAMPLE 6)

(EXPERIMENTAL EXAMPLE 7)

(EXPERIMENTAL EXAMPLE 8)

(EXPERIMENTAL EXAMPLE 16)

(EXPERIMENTAL EXAMPLE 17)

(EXPERIMENTAL EXAMPLE 18)

(EXPERIMENTAL EXAMPLE 19)

(EXPERIMENTAL EXAMPLE 20)

(EXPERIMENTAL EXAMPLE 21)

(EXPERIMENTAL EXAMPLE 22)

(EXPERIMENTAL EXAMPLE 23)

(EXPERIMENTAL EXAMPLE 24)

(EXPERIMENTAL EXAMPLE 25)

(EXPERIMENTAL EXAMPLE 26)

(EXPERIMENTAL EXAMPLE 27)

SPARK PLUG FOR INTERNAL COMBUSTION ENGINE HAVING A SHAPED COMPOSITE CHIP ON CENTER ELECTRODE AND/OR GROUND ELECTRODE

CROSS-REFERENCE TO RELATED APPLICATION

The present application is a continuation application of International Application No. PCT/JP2018/038822 filed on Oct. 18, 2018, which claims priority to Japanese Patent Application No. 2017-202589 filed on Oct. 19, 2017 and Japanese Patent Application No. 2018-189149 filed on Oct. 4, 2018. The contents of these application are incorporated herein by reference in their entirety.

BACKGROUND

Technical Field

The present disclosure relates to a spark plug for an internal combustion engine.

Background Art

An internal combustion engine such as an automobile engine is provided with an ignition device including a spark plug for generating a spark discharge to ignite a mixed gas of fuel gas and air. In recent years, lean burning has been used to improve the fuel efficiency of internal combustion engines. To improve ignitability for lean burning, the tips of electrodes forming a spark gap have been shaped as chips.

SUMMARY

An aspect of the present disclosure is a spark plug for an internal combustion engine, and the spark plug includes:

a center electrode;

a ground electrode; and a composite chip formed on at least one of the center electrode and the ground electrode.

The composite chip includes a core, and a cup-shaped surface layer having a discharge portion and a side surface coating.

The core is formed from a Ni alloy material, and the surface layer is formed from a Pt alloy material.

In the surface layer, the coating thickness S of the side surface coating in the radial direction, the outer diameter D1 of the discharge portion, and the coating length L1 of the side surface coating in the axial direction satisfy the relation represented by expression 1:

$$S \geq D1/20 + L1/10 - 0.005 \text{ mm.} \qquad \text{Expression 1:}$$

BRIEF DESCRIPTION OF THE DRAWINGS

The above and other objects, features, and advantages of the present disclosure will be clearly apparent from the detailed description provided below with reference to the accompanying drawings, in which.

DETAILED DESCRIPTION OF THE PREFERRED EMBODIMENTS

Figure 1:
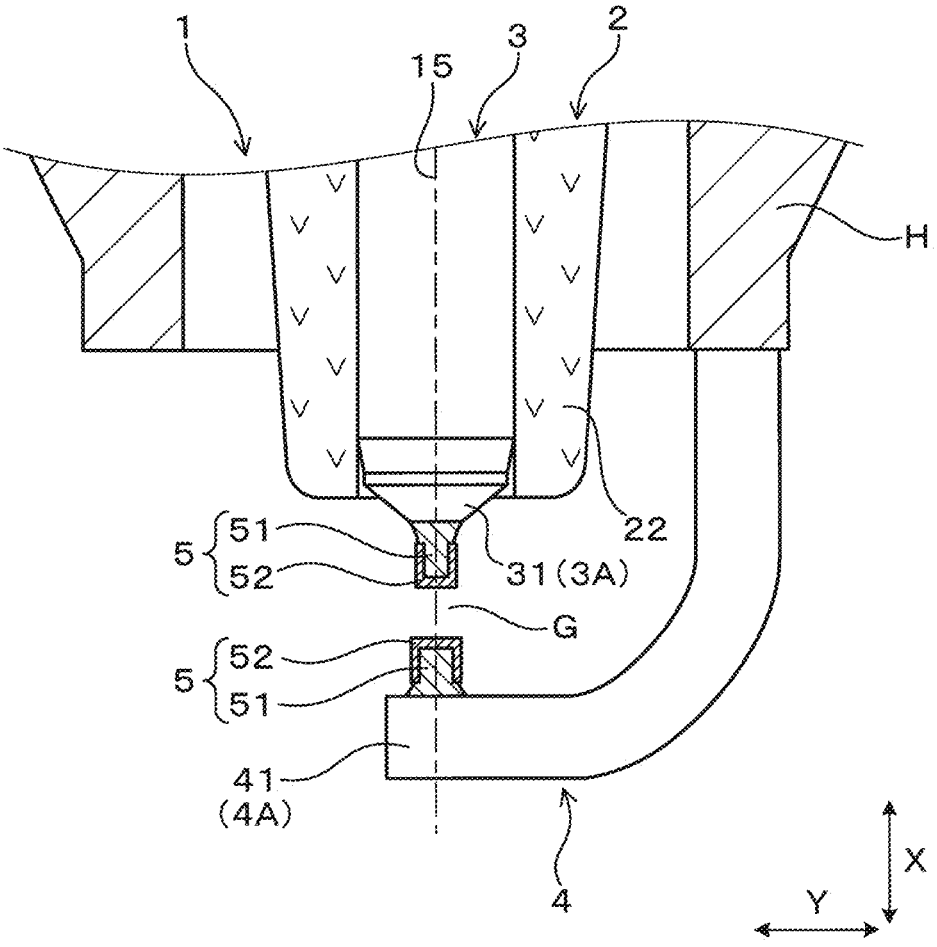
FIG. 1 is an enlarged cross-sectional view showing a primary part of a spark plug according to a first embodiment.

To improve ignitability for lean burning, tips of electrodes forming a spark gap have been shaped as chips. For example, a spark plug disclosed in JP 5545166 B has a needle-shaped chip which is formed on at least one of its center electrode and ground electrode and is a composite chip formed of a base material joining portion and a discharge portion in order to improve the ignitability and reduce cost. The discharge portion is formed from a high-density material such as noble metal and covers at least a part of the side surface of the base material joining portion, and the thickness of the discharge portion decreases toward the electrode base material in order to reduce noble metal usage.

JP 6017027 B discloses a spark plug in which at least one of its center electrode and ground electrode is formed of a shaft and an electrode chip joined to one surface of the shaft. In the shaft, a first core formed of a material that contains copper is coated with a first outer layer having corrosion resistance higher than that of the first core, while in the electrode chip a second outer layer forming its outer surface and formed from a material containing noble metal covers a second core having a thermal conductivity higher than that of the second outer layer. Additionally, the first core and the second core are joined together via a diffusion bonded area, while the first outer layer and the second outer layer are joined together via a laser melted area.

Since a lean burn engine accelerates the flow velocity in each cylinder to promote combustion, a spark discharge generated in spark gap tends to be blown by an airflow. In such a case, a high-speed airflow may change a discharge path to shift a spark discharge toward the proximal end of the chip, causing side surface wear on the chip. In addition, to suppress a spark from blown out by a change of the discharge path, the ignition energy has become greater than before, which tends to cause the electrodes to wear at an accelerated rate and also increases side surface wear on the chip.

In the structure disclosed in JP 5545166 B, since the discharge portion covering the side surface of the base material joining portion thins toward the proximal end of the side surface, the base material joining portion having lower wear resistance may be exposed when the thin portion is quickly worn. Alternatively, if the thin portion cracks under thermal stress due to the difference in coefficients of linear expansion from the base material joining portion, the base material joining portion is exposed and tends to wear further. It is thus desired to further improve the wear resistance of the chip side surface.

In the structure disclosed in JP 6017027 B, the second outer layer of the electrode chip covers the entire second core and thus contains a larger amount of noble metal. The costs are accordingly high. In addition, the second outer layer is directly joined and fixed to the first outer layer for the shaft, and if the second outer layer becomes thinner, cracks tend to occur due to the difference in coefficients of linear expansion. Furthermore, such different metals make it difficult to increase their bonding strength.

An object of the present disclosure is to provide a spark plug for an internal combustion engine having a long service life and excellent ignitability by reducing side surface wear on a composite chip and noble metal material usage.

An aspect of the present disclosure is a spark plug for an internal combustion engine, and the spark plug includes:

a center electrode held inside a cylindrical insulator and protruding from the tip of the insulator toward a distal end;

a ground electrode provided on the distal end of a housing holding the insulator, the ground electrode facing the center electrode in the axial direction; and a composite chip formed on at least one of the center electrode and the ground electrode and protruding in the axial direction.

The composite chip includes a core having a mount formed integrally with an electrode base material, and a cup-shaped surface layer having a discharge portion covering the protrusion end surface of the core and a side surface coating covering a side surface continuous to the protrusion end surface.

The core is formed from a Ni alloy material, and the surface layer is formed from a Pt alloy material.

In the surface layer, the coating thickness S of the side surface coating in the radial direction, the outer diameter D1 of the discharge portion, and the coating length L1 of the side surface coating in the axial direction satisfy the relation represented by expression 1:

$$S \geq D1/20 + L1/10 - 0.005 \text{ mm.} \qquad \text{Expression 1:}$$

In the spark plug for an internal combustion engine, the cup-shaped surface layer covering the core of the composite chip is formed so that the outer diameter D1 of the discharge portion and the coating thickness S and the coating length L1 of the side surface coating satisfy the relation represented by expression 1. Thus, the spark plug can prevent cracking in the side surface coating. More specifically, thermal stress that may cause cracking is generated by the difference in coefficients of linear expansion between the Ni alloy material constituting the core and the Pt alloy material constituting the surface layer. Further, it is considered that factors in cracking are both the thermal stress generated in the radial direction due to the outer diameter D1 of the discharge portion and the thermal stress generated in the axial direction due to the coating length L1 of the side surface coating.

Thus, appropriately setting the coating thickness S of the side surface coating so as to satisfy expression 1 incorporating both factors can reduce Pt alloy material usage and also suppress cracking. The suppression of cracking can minimize the exposure of the core to increase the wear resistance of the composite chip.

According to the aspects described above, a spark plug for an internal combustion engine is provided having a long service life and excellent ignitability by reducing side surface wear on its composite chip and noble metal material usage.

First Embodiment

A first embodiment of a spark plug for an internal combustion engine will now be described with reference to FIGS. 1 to 5.

As shown in FIG. 1, a spark plug 1 includes a center electrode 3 held inside a cylindrical insulator 2, a ground electrode 4 provided at the distal end of a housing H and facing the center electrode 3 in the axial direction X, and a composite chip 5 formed on at least one of the center electrode 3 and the ground electrode 4. The center electrode 3 protrudes from the tip of the insulator 2 toward a distal end, and the housing H holds the insulator 2 therein.

In the present embodiment, the composite chip 5 is installed on each of the center electrode 3 and the ground electrode 4, and the composite chips 5 extend in the axial direction X (i.e., the vertical direction in the figure) and face each other. Each of the composite chips 5 on the center electrode 3 and on the ground electrode 4 has the same structure and includes a core 51 and a cup-shaped surface layer 52 covering the core 51. An internal combustion engine in which the spark plug 1 is used, is a lean burn engine for an automobile, for example.

Figure 2:
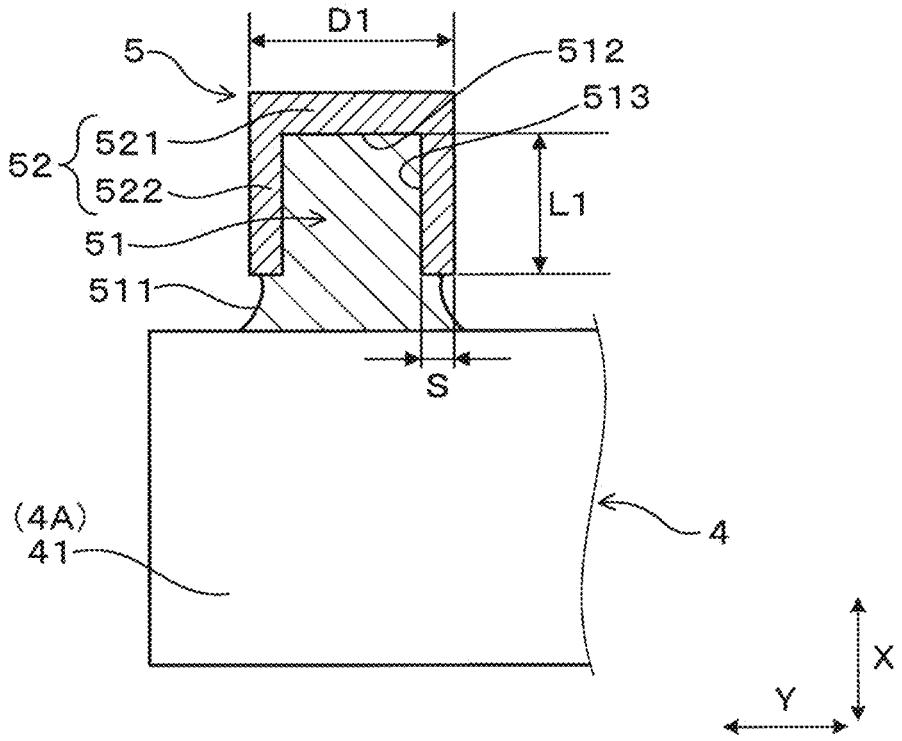
FIG. 2 is an enlarged cross-sectional view of a main part showing a composite chip area of the spark plug according to the first embodiment.

As shown in FIG. 2, in which the composite chip 5 installed on the ground electrode 4 is depicted as an example, the core 51 has a mount 511 integrally joined to an electrode base material 4A for the ground electrode 4. The surface layer 52 includes a discharge portion 521 covering a protrusion end surface 512 of the core 51, and a side surface coating 522 covering a side surface 513 continuous to the protrusion end surface 512. The core 51 is formed from a Ni alloy material, and the surface layer 52 is formed from a Pt alloy material.

The surface layer 52 is formed so that the outer diameter D1 of the discharge portion 521, the coating thickness S of the side surface coating 522 in the radial direction Y (i.e., the right-left direction in the figure), and the coating length L1 of the side surface coating 522 in the axial direction X satisfy the relation represented by expression 1.

$$S \geq D1/20 + L1/10 - 0.005 \text{ mm} \qquad \text{Expression 1:}$$

The spark plug 1 according to the present embodiment will be described in detail below.

Figure 3:
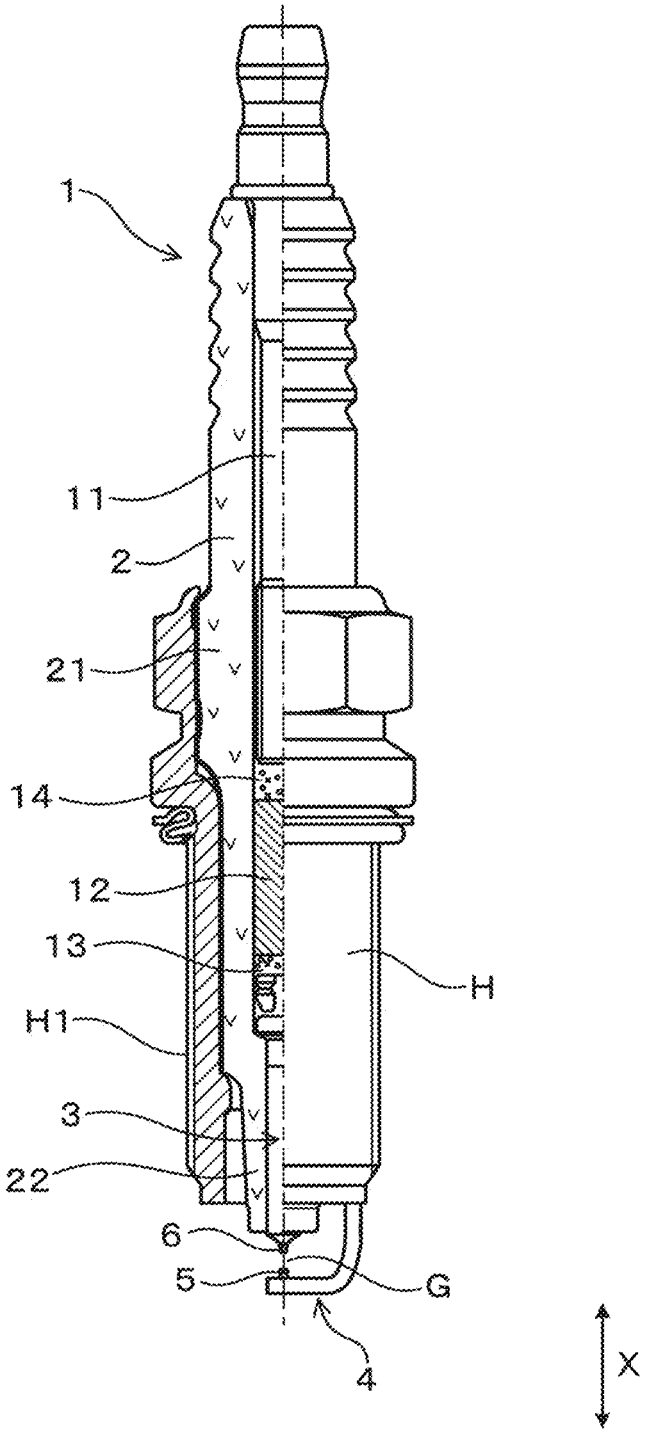
FIG. 3 is a partially sectioned front view showing the entire structure of the spark plug according to the first embodiment.

As shown in FIG. 3, the spark plug 1 includes the cylindrical housing H extending in the axial direction X. The housing H has a mounting thread Hi formed in its outer peripheral surface adjacent to the distal end (i.e., the bottom in the figure). The inner peripheral surface of the housing H adjacent to the proximal end (i.e., the top in the figure) is stepped in a manner to widen toward the proximal end, and the step supports the outer periphery of a middle area 21 formed as a large-diameter part of the insulator 2. The insulator 2 includes a tip 22 tapered with its diameter reduced toward the distal end and protruding toward the distal end from the distal end of the housing H, and has a gap between the insulator 2 and the inner peripheral surface of the housing H.

Inside the cylindrical insulator 2, the elongated center electrode 3 is provided at its distal end side and an elongated metal terminal 11 is coaxially provided at its proximal end side. The center electrode 3 is electrically connected to the metal terminal 11 via a resistor 12. The metal terminal 11 has a proximal end protruding from the proximal end of the insulator 2 and connected to an external power supply (not shown), enabling feed of high voltage for ignition. The resistor 12 is obtained by dispersing a conductive material such as a carbon material in a substrate including a glass material and an aggregate, conductive glass seal layers 13 and 14 are respectively filled with between the resistor 12 and the center electrode 3 or the metal terminal 11. The housing H is formed from, for example, a metal material such as iron based alloy, and the insulator 2 is formed from an electrically insulating ceramic material such as alumina.

The spark plug 1 is attached to a cylinder of an internal combustion engine (not shown) with the distal plug end exposed in the cylinder. The composite chip 6 on the distal end of the center electrode 3 and the opposite composite chip 5 on the ground electrode 4 form a spark gap G between them. When the center electrode 3 is fed with a predetermined high voltage at a predetermined point in time from the external power supply, the spark gap G has a spark discharge generated, which ignites and burns an air-fuel mixture fed into the cylinder.

In FIG. 1, the ground electrode 4 is integral with the distal end surface of the housing H, extends toward the distal end, and is bent into a substantial L-shape. The extension end of the ground electrode 4 is a tip 41, which faces a tip 31 of the center electrode 3 in the axial direction X. The tip 31 of the center electrode 3 is tapered with its diameter reduced toward the distal end and the composite chip 5 is joined to its distal end surface protruding from the tip of the insulator 2 toward the distal end. The composite chip 5 is joined to the tip 41 of the ground electrode 4 on its surface facing the center electrode 3. The composite chip 5 on the center electrode 3 and the composite chip 5 on the ground electrode 4 are coaxially arranged at a predetermined distance on a plug central axis 15, and form the spark gap G between the composite chips 5.

In FIG. 2, each composite chip 5 is substantially columnar in general and formed as a needle-shaped chip protruding in the axial direction X from the tip 41 of the ground electrode 4. The composite chip 5 holds the core 51 in close contact inside the cup-shaped surface layer 52, which forms the outer surface of composite chip 5. The mount 511 of the core 51, which is exposed from the surface layer 52, is integrally joined to the tip 41 of the ground electrode 4. The surface layer 52 has the shape of a cylindrical cup which has a substantially constant outer diameter, and the bottom of which corresponds to the end of the chip protrusion, and includes the discharge portion 521 positioned over the protrusion end surface 512 of the core 51 in the axial direction X, and the side surface coating 522 positioned around, in the radial direction Y, the side surface 513 continuous to the protrusion end surface 512.

The surface layer 52 is formed from an alloy material containing Pt, which is a high-density material. Pt alloy materials have high melting points and is excellent in oxidation resistance and thus improve the wear resistance of the surface layer 52. Pt alloy materials are also ductile materials, which advantageously facilitate forming the surface layer 52 into the cup shape. Specifically, materials in which Pt is added with other noble metal, such as Pt—Rh alloy, Pt—Ir alloy, and Pt—Pd alloy, or materials in which Pt is added with non-noble metal for example Ni, such as Pt—Ni alloy can be used. Suitably, Pt—Rh alloy or Pt—Ni alloy is desirably used as the Pt alloy material.

If Pt—Rh alloy is used as the Pt alloy material, the Pt—Rh alloy may have a Rh content within a range of 10 mass % to 30 mass %. In this state, the coefficient of linear expansion is within a range of, for example, $9.5\times10^{-6}$/° C. to $12.0\times10^{-6}$/° C. (i.e., the coefficient of linear expansion at 900° C. when a reference temperature is 50° C.). Although both Pt and Rh are materials having oxidation resistance, Pt has a relatively low melting point among noble metals (more specifically, 1,770° C.). Thus, Pt—Rh alloy, which is obtained by adding Rh which has a higher melting point (more specifically, 1,960° C.), ensures resistance to spark wear and oxidation resistance. When a Rh content is less than 10 mass %, sufficient effect of improving the wear resistance by increasing the melting point may be obtained, and when a Rh content is greater than 30% by mass, the hardness may increase and the formability into a cup shape may reduce.

If Pt—Ni alloy is used as the Pt alloy material, the Pt—Ni alloy may have a Ni content within a range of 5 mass % to 20 mass %. In this state, the coefficient of linear expansion is within a range of, for example, $10.5\times10^{-6}$/° C. to $13.0\times10^{-6}$/° C. (i.e., the coefficient of linear expansion at 900° C. when a reference temperature is 50° C.). Pt is expensive since it is a noble metal, and its price fluctuations may greatly affect costs. The addition of Ni, which is a non-noble metal, can reduce costs. When a Ni content is less than 5 mass %, effect of a reduction in costs may be insufficient. When a Ni content is greater than 20 mass %, the hardness may increase and the formability into a cup shape may reduce.

The core 51 is formed from an alloy material containing Ni, which is a low-density material. Ni alloy materials are non-noble metal materials and less expensive than the Pt alloy material forming the surface layer 52, and thus contribute to cost reduction. In addition, Ni alloy materials allow a reduction in the amount of the high-density Pt alloy material for the prevention of problems such as the composite chip 5 coming off due to its own weight. More specifically, Ni—Cr based alloy or Ni—Cr—Fe based alloy can suitably employed as Ni alloy materials. The Ni content may be within a range of, for example, 50 mass % to 90 mass %. An element other than Cr and Fe, such as Mo, Al, Co, Mn, Si, C, or S, may be added to Ni. The coefficient of linear expansion of such a Ni alloy material is usually higher than that of the Pt alloy material and, for example, may be within a range of $14.0\times10^{-6}$/° C. to $17.0\times10^{-6}$/° C. (i.e., the coefficient of linear expansion at 900° C. when a reference temperature is 50° C.). Although iron based materials are widely used as non-noble metals, the composite chip 5 of the spark plug 1, which is exposed in the engine combustion chamber, is exposed under a high-temperature and highly oxidative environment, and thus a Ni based material is suitably used because of its oxidation resistance.

The core 51 and the surface layer 52 are fixed in close contact to each other by, for example, press-fitting or resistance welding. When fixed in close contact, the core 51 and the surface layer 52 may be heat-treated to improve their bonding properties through diffusion bonding. In some cases, the surface layer 52 may be formed into the cup shape while the core 51 is being inserted in the same process. Then, the mount 511, which is exposed from the surface layer 52, may be disposed on the tip 41 of the ground electrode 4 and bonded by resistance welding or laser welding. The ground electrode 4 (or the electrode base material 4A) may be formed from, for example, a Ni alloy material. The use of the same material as the core 51 can reduce thermal stress.

For the mount 511 shown in FIG. 2, for example, the end surface in the axial direction is bonded to the surface of the ground electrode 4 by resistance welding, the peripheral surface is bonded to the surface of the ground electrode 4 by laser welding and curved in a manner to slightly broaden toward the base. The laser welding is used to melt and solidify the bonding interface of the mount 511, forming a melted area that ensures bondability. Some of the materials forming the surface layer 52 may be melted into the core 51 resulting a melted area alloyed. In this case, the material composition of at least a part of the mount 511 is Ni alloy containing Pt, which forms the surface layer 52.

For the composite chip 5 thus obtained by combining the core 51 and the surface layer 52, by including the core 51 inside the surface layer 52, expensive Pt alloy material usage can be reduced with its wear resistance maintained, while the bondability of the mount 511 to the ground electrode 4 can be ensured.

The composite chip 5 installed on the center electrode 3 may also have the same structure. At the tip 31 of the center electrode 3, the mount 511 of the core 51 is formed integrally with an electrode base material 3A (e.g., see FIG. 1) for the center electrode 3, and the surface layer 52 covering the protrusion of the core 51 is provided.

The effects of the shape of the composite chip 5, in particular, the relation between the outer diameter D1 of the surface layer 52, and the coating length L1 and the coating thickness S of the side surface coating 522 shown in expression 1 mentioned above will now be described.

Figure 4:
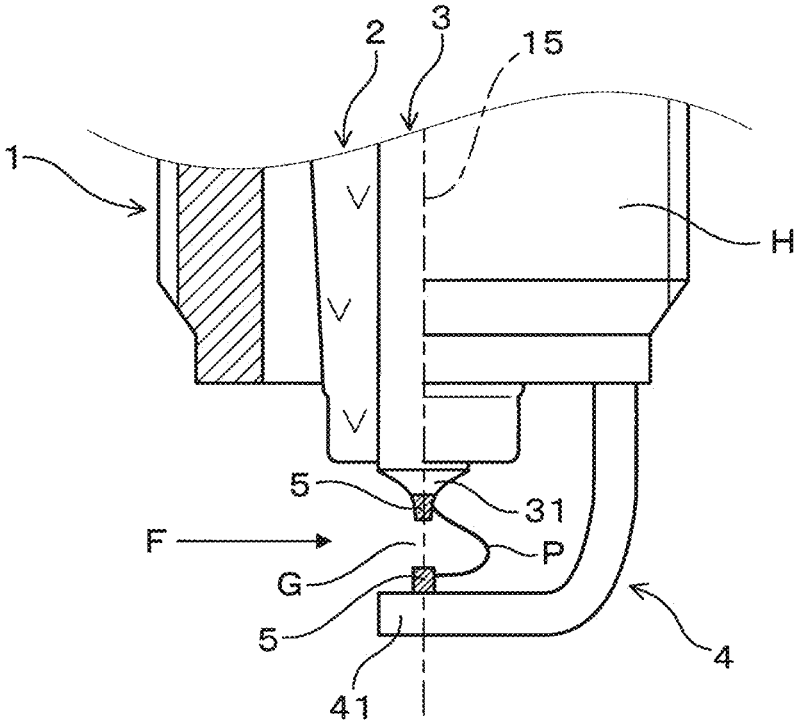
FIG. 4 is an enlarged cross-sectional view of a main part illustrating a spark discharge in the spark gap of the spark plug according to the first embodiment.

As shown in FIG. 4, for a lean burn engine, in which air flows in its cylinders at high speed, the composite chips 5 forming the spark gap G for the spark plug 1 is exposed to a high-speed airflow F. Thus, when the two composite chips 5 facing each other across the spark gap G have a spark discharge P generated between them, the spark discharge P tends to be blown by, for example, the lateral airflow F indicated by an arrow in the figure. When the spark discharge P is extended laterally in this manner (i.e., in the direction of the airflow F), either end of the spark discharge P shifts from the outer periphery to the side surface of the composite chip 5 on the center electrode 3 or from the outer periphery to the side surface of the composite chip 6 on the ground electrode 4.

Figure 5:
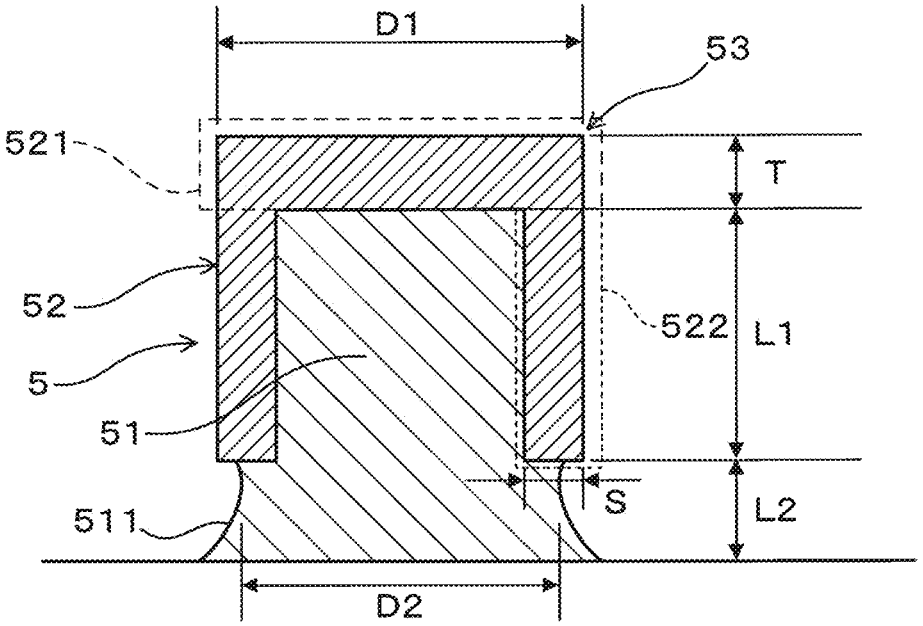
FIG. 5 is an enlarged cross-sectional view of a main part illustrating the structure of the composite chip according to the first embodiment.

In this state, it has been found that the spark discharge P concentrates and increases wear on the outer periphery of the composite chip 5 shown in FIG. 5, that is, near an edge 53 from the outer peripheral edge of the discharge portion 521 of the surface layer 52 to the side surface coating 522. In particular, when the spark discharge P is blown and shifted by the airflow F to the side surface, the relatively thin side surface coating 522 wears, and a crack tends to appear under thermal stress. More specifically, repeated cycles of heating by the heat of the spark discharge P and cooling by the airflow F lead to thermal stress, due to a difference in coefficients of linear expansion, on the bonding interface between the core 51 formed of a Ni alloy material and the surface layer 52 formed of a Pt alloy material, which has a lower coefficient of linear expansion. Then, the thin side surface coating 522 extends to increase the possibility of cracking. Furthermore, the high temperature corrosive atmosphere in the cylinders may cause cracked areas to undergo high temperature oxidation, and the surface layer 52 to detach. As a result, if a core 51 which is more susceptible to wear is exposed, the wear will be increased at an accelerated rate and shorten the service life of the spark plug 1.

Thus, the coating thickness S and the coating length L1 of the side surface coating 522 are set based on expression 1 below, which is derived from evaluation test 1 described later.

$$S \geq D1/20 + L1/10 - 0.005 \text{ mm} \quad \text{Expression 1:}$$

The test results have revealed that the relation between its coating thickness S and coating length L1 and the outer diameter D1 of the discharge portion 521 is important in cracking in the side surface coating 522. More specifically, cracking is affected by both the thermal stress in the axial direction X due to the coating length L1 of the side surface coating 522 and the thermal stress in the radial direction Y due to the outer diameter D1 of the discharge portion 521. Either dimension increases with its thermal stress and possibility of cracking. Against the thermal stress due to these dimensions, the wear resistance can be improved by determining the coating thickness S appropriately in a manner to satisfy the relation represented by expression 1.

Suitably, the coating thickness S of the side surface coating 522 is set to be equal to or smaller than the coating thickness T of the discharge portion 521 in the axial direction X (i.e., T≥S). More suitably, the coating thickness S may be smaller than the coating thickness T of the discharge portion 521 (i.e., T>S). By setting the thickness not larger than necessary within a range that satisfies expression 1, the amount of the expensive noble metal material used in the surface layer 52 can be reduced. The coating thickness T of the discharge portion 521 may be within a range of, for example, 0.15 mm≤T≤0.25 mm. This range provides sufficient wear resistance against wear over time and increasing discharge maintaining voltage with the spark gap G widening due to the wear.

Since the composite chip 5 has a structure having bonded different members of the core 51 formed from a Ni alloy material, which has a high coefficient of linear expansion and is a low density material, and the surface layer 52 formed from a Pt alloy material, which has a low coefficient of linear expansion is a high density material, it seems that thermal stress due to the difference in the coefficients of linear expansion causes cracks in the side surface coating 522. One factor in occurrence of cracking is the thermal stress applied in the radial direction Y due to the outer diameter D1 of the discharge portion 521, and the larger the outer diameter D1 is, the larger the thermal stress become. Another factor is the thermal stress applied in the axial direction X due to the coating length L1 of the side surface coating 522, and the thermal stress increases in proportion to the coating length L1.

Considering these thermal stress factors, the coating thickness S sufficient to prevent cracking may be set to improve the strength against the thermal stress, enabling the prevention of cracks. These factors are respectively reflected in the first term (i.e., D1/20) and the second term (i.e., L1/10) of expression 1.

Suitably, the outer diameter D1 of the discharge portion 521 is determined to be within a range of 0.5 mm≤D1≤1.1 mm. As the outer diameter D1 increases, the discharge portion 521 improves in wear resistance, but more of the thermal energy of the spark discharge P is absorbed by the discharge portion 521 to increase fire retardancy. In contrast, as the outer diameter D1 decreases, the fire retardancy decreases and the ignitability improves, but the wear resistance also decreases. Thus, the outer diameter D1 may be selected as appropriate from the above range to maintain both the ignitability and the wear resistance.

The coating length L1 of the side surface coating 522 is set to be within a range of 0.2 mm≤L1≤0.5 mm. A greater coating length L1 increases the effect of reducing wear on the side surface by covering an area against the spark discharge P shifting to the side surface coating 522. However, as the coating length L1 becomes greater, the thermal stress along the axial direction X tends to increase. Thus, in a typical internal combustion engine, the coating length L1 may be selected as appropriate from the above range to prevent thermal stress as well as provide sufficient covering against the spark discharge P shifted by the airflow F in the cylinder.

The exposed length L2 of the mount 511 in the axial direction X is set as appropriate so that the total length of the composite chip 5 in the axial direction X (i.e., the chip length=T+L1+L2) becomes a defined length. Suitably, the exposed length L2 may be within a range of 0.2 mm≤L2≤0.5 mm. As the outer peripheral surface of the mount 511 is not coated with the surface layer 52 but exposed in the atmosphere in the cylinder, heat dissipation can be improved to reduce the thermal expansion of the core 51. However, for a greater exposed length L2, the heat dissipation from the core 51 may be accelerated to unnecessarily increase the fire retardancy. Thus, the exposed length L2 may be determined as appropriate within the above range to achieve good ignitability as well as prevent cracking due to thermal stress.

Furthermore, the ratio of the diameter D2 of the smallest-diameter part of the mount 511 exposed from the side surface coating 522 and to the outer diameter D1 of the discharge portion 521 (D2/D1) desirably satisfies the relation represented by expression 2, which is derived from evaluation test 2 described later.

$$D2/D1 \geq 0.8 \quad \text{Expression 2:}$$

As the ignition energy increases, the discharge portion 521 tends to wear due to the heat of the spark discharge P. It is thus desirable to properly transfer the heat from the discharge portion 521 to the electrode base material 4A via the core 51. However, if the mount 511 has a small diameter relative to the outer diameter D1 of the discharge portion 521, the thermal energy of the spark discharge P may be difficult to transfer. Suitably, the diameter D2 of the smallest-diameter part of the mount 511 and the outer diameter D1 of the discharge portion 521 may be determined as appropriate so that D2/D1 meets expression 2, to improve the wear resistance.

(Evaluation Test 1)

The spark plug 1 according to the first embodiment was evaluated for the appearance of cracks in the side surface coating 522 with varying outer diameters D1 of the discharge portion 521 of the composite chip 5, and varying coating thicknesses S and coating lengths L1 of the side surface coating 522.

As shown in FIGS. 6 to 9, different samples with different dimensions were prepared for experimental examples 1 to 8. Each of the samples for experimental examples 1 to 8 was a composite chip 5 made from alloy materials, with its core 51 formed from Ni—Cr—Fe based alloy (more specifically, 72% by mass of Ni, 17% by mass of Cr, and 10% by mass of Fe; coefficient of linear expansion: $16.4\times10^{-6}$/° C.) and its surface layer 52 formed from Pt—Rh alloy (more specifically, 80% by mass of Pt and 20% by mass of Rh; coefficient of linear expansion: $9.9\times10^{-6}$/° C.). It is noted that the coefficient of linear expansion was measured at 900° C. (reference temperature: 50° C.) and the same applies hereinafter.

In evaluation test 1, the spark plug 1 provided with each composite chip 5 having the dimensions specified in each experimental example was set on a heating and cooling bench, the temperature of which can be controlled, and a temperature cycle was repeated under the conditions described below. In each cycle, the sample placed in a heating furnace was heated to 950° C. and allowed to stand for one minute, and then cooled to 150° and allowed to stand for one minute. The cycle was repeated 200 times. Then, the sample was taken out into the room and air-cooled. The results of the 200-cycle durability test are shown in FIGS. 6 to 9, in which each circle denotes that the sample was good (○), or no cracks appeared in the side surface coating 522, and each cross denotes that the sample was poor (x), or cracks appeared in the side surface coating 522.

Figure 6:
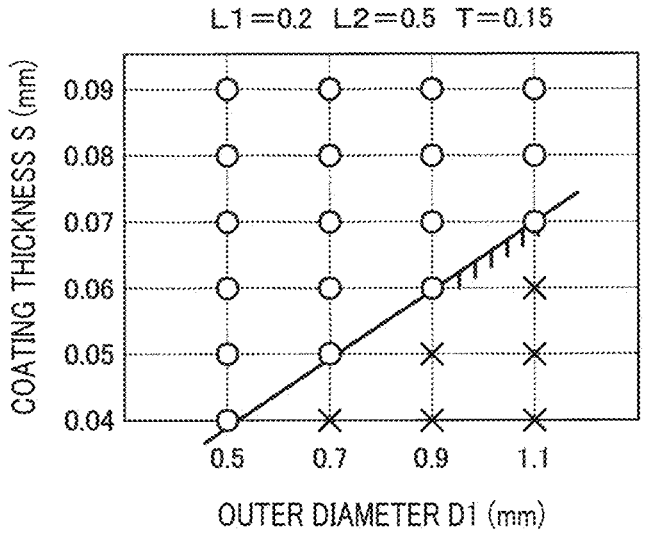
FIG. 6 shows relations observed in evaluation test 1 between the outer diameter D1 of a discharge portion and the coating thickness S of a side surface coating in experimental examples 1 and 2 (more specifically, coating length L1: 0.2 mm)
Figure 6:
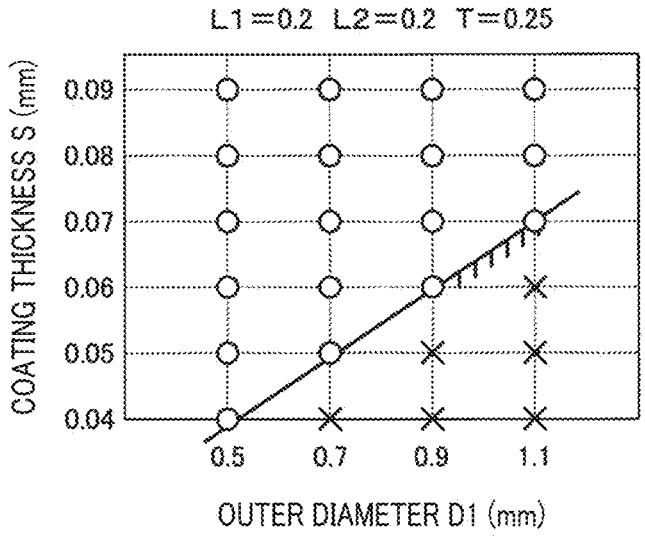

In experimental examples 1 and 2 shown in FIG. 6, the coating length L1 was fixed at 0.2 mm, while the coating thickness S was varied in increments of 0.01 mm within a range of 0.04 mm to 0.09 mm, and the outer diameter D1 of the discharge portion 521 was varied in increments of 0.2 mm within a range of 0.5 mm to 1.1 mm. In experimental example 1, the mount 511 of the core 51 had an exposed length L2 fixed at 0.5 mm, and the discharge portion 521 of the surface layer 52 had a coating thickness T fixed at 0.15 mm. In experimental example 2, with the exposed length L2 fixed at 0.2 mm, and the coating thickness T of the discharge portion 521 fixed at 0.25 mm. The relation between the appearance of cracks and combinations of coating thicknesses S and outer diameters D1 was assessed.

As shown in the upper and the lower parts of FIG. 6, there is a correlation between the coating thicknesses S and the outer diameters D1 that cause no cracks, and experimental examples 1 and 2 gave equivalent results. More specifically, the expressions of the boundary lines shown in this figure have indicated that, with the coating length L1 fixed at 0.2 mm, the combinations satisfying the expression, $S \geq D1/20+0.015$ mm, cause no cracks irrespective of the coating thickness T of the discharge portion 521 and the exposed length L2 of the mount 511. Each of the combinations satisfying the expression, $S<D1/20+0.015$ mm, caused cracks due to the thermal expansion of the core 51.

In experimental examples 3 and 4, evaluation was performed in the same manner as in experimental example 1 except that the coating length L1 was fixed at 0.3 mm. More specifically, the coating thickness S was varied within a range of 0.04 mm to 0.09 mm, and the outer diameter D1 of the discharge portion 521 was varied within a range of 0.5 mm to 1.1 mm. In experimental example 3, the mount 511 had an exposed length L2 fixed at 0.5 mm, and the discharge portion 521 had a coating thickness T fixed at 0.15 mm. In experimental example 4, with the exposed length L2 fixed at 0.2 mm, and the coating thickness T of the discharge portion 521 fixed at 0.25 mm. The relation between the appearance of cracks and combinations of coating thicknesses S and outer diameters D1 was assessed.

Figure 7:
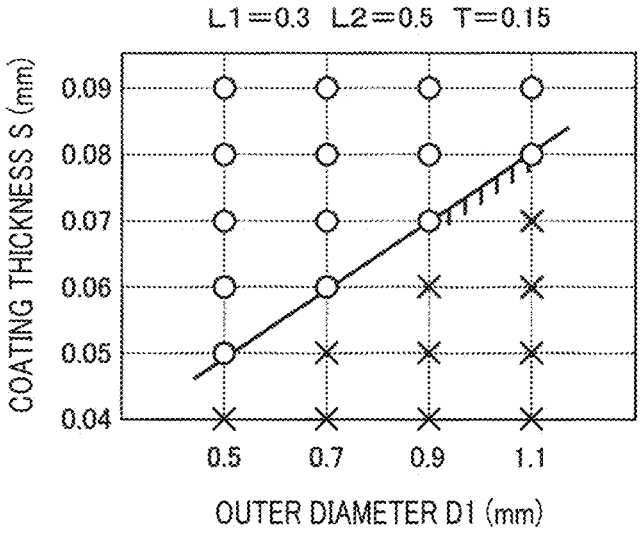
FIG. 7 shows relations observed in evaluation test 1 between the outer diameter D1 of the discharge portion and the coating thickness S of the side surface coating in experimental examples 3 and 4 (more specifically, coating length L1: 0.3 mm)
Figure 7:
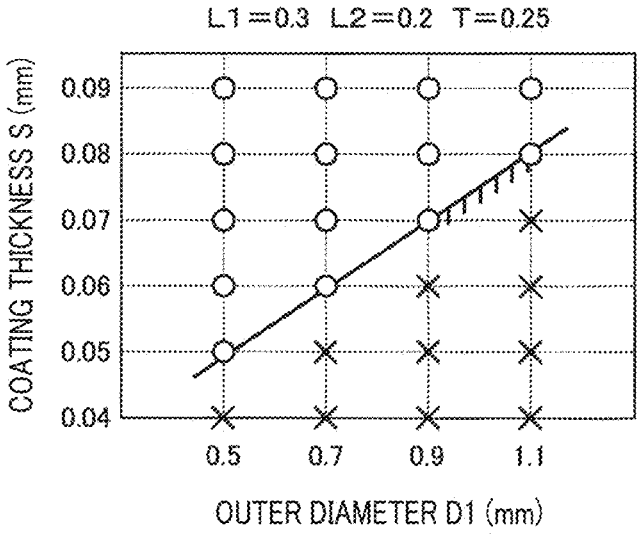

As shown in the upper and the lower parts of FIG. 7, also for the coating length L1 fixed at 0.3 mm, experimental examples 3 and 4 gave equivalent results. More specifically, the expressions of the boundary lines shown in this figure have indicated that the combinations satisfying the expression, $S \geq D1/20+0.025$ mm, caused no cracks irrespective of the coating thickness T of the discharge portion 521 and the exposed length L2 of the mount 511. The combinations satisfying the expression, $S<D1/20+0.025$ mm, caused cracks due to the thermal expansion of the core 51.

In experimental examples 5 and 6, evaluation was performed in the same manner as in experimental example 1 except that the coating length L1 was fixed at 0.4 mm. More specifically, the coating thickness S was varied within a range of 0.04 mm to 0.09 mm, and the outer diameter D1 of the discharge portion 521 was varied within a range of 0.5 mm to 1.1 mm. In experimental example 5, the mount 511 had an exposed length L2 fixed at 0.5 mm, and the discharge portion 521 had a coating thickness T fixed at 0.15 mm. In experimental example 6, with the exposed length L2 fixed at 0.2 mm, and the coating thickness T of the discharge portion 521 fixed at 0.25 m. The relation between the appearance of cracks and combinations of coating thicknesses S and outer diameters D1 was assessed.

Figure 8:
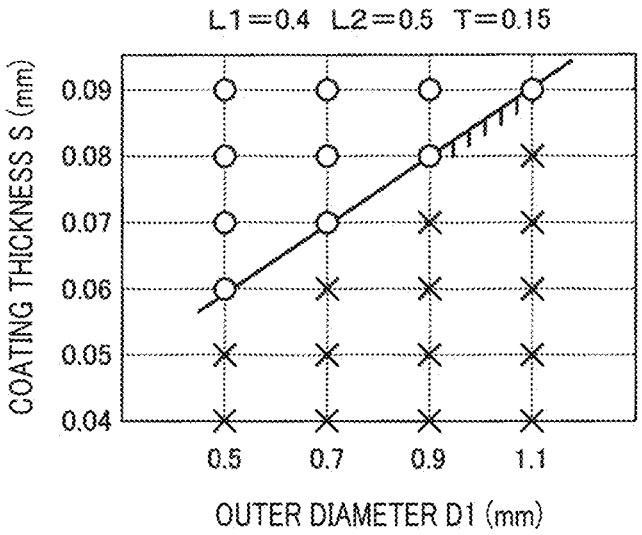
FIG. 8 shows relations observed in evaluation test 1 between the outer diameter D1 of the discharge portion and the coating thickness S of the side surface coating in experimental examples 5 and 6 (more specifically, coating length L1: 0.4 mm)
Figure 8:
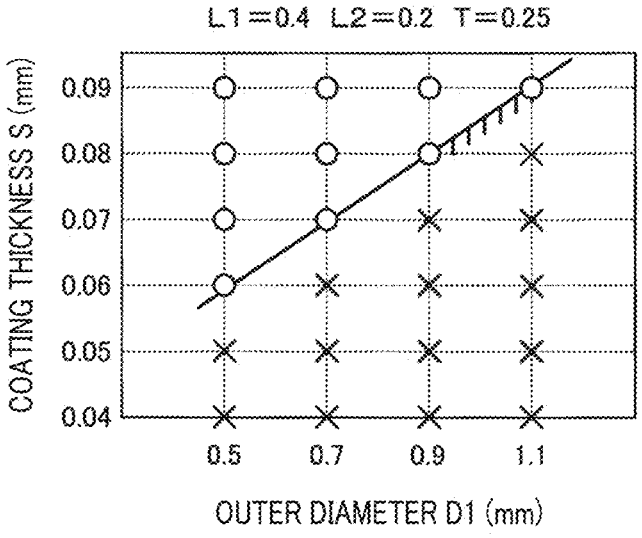

As shown in the upper and the lower parts of FIG. 8, also for the coating length L1 fixed at 0.4 mm, experimental examples 5 and 6 gave equivalent results. More specifically, the expressions of the boundary lines shown in this figure have indicated that the combinations satisfying the expression, $S \geq D1/20+0.035$ mm, caused no cracks irrespective of the coating thickness T of the discharge portion 521 and the exposed length L2 of the mount 511. The combinations satisfying the expression, $S<D1/20+0.035$ mm, caused cracks due to the thermal expansion of the core 51.

In experimental examples 7 and 8, evaluation was performed in the same manner as in experimental example 1 except that the coating length L1 was fixed at 0.5 mm. More specifically, the coating thickness S was varied within a range of 0.04 mm to 0.09 mm, and the outer diameter D1 of the discharge portion 521 was varied within a range of 0.5 mm to 1.1 mm. In experimental example 7, the mount 511 had an exposed length L2 fixed at 0.5 mm, and the discharge portion 521 had a coating thickness T fixed at 0.15 mm. In experimental example 8, with the exposed length L2 fixed at 0.2 mm, and the coating thickness T of the discharge portion 521 fixed at 0.25 mm. The relation between the appearance of cracks and combinations of coating thicknesses S and outer diameters D1 was assessed.

Figure 9:
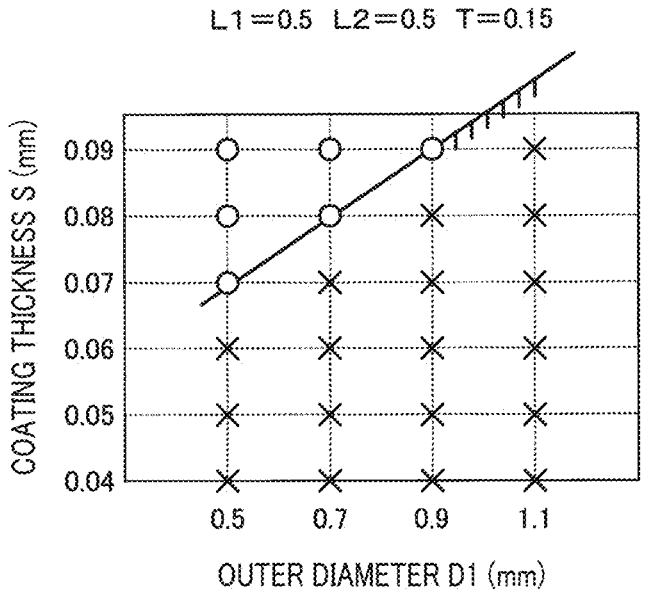
FIG. 9 shows relations observed in evaluation test 1 between the outer diameter D1 of the discharge portion and the coating thickness S of the side surface coating in experimental examples 7 and 8 (more specifically, coating length L1: 0.5 mm)
Figure 9:
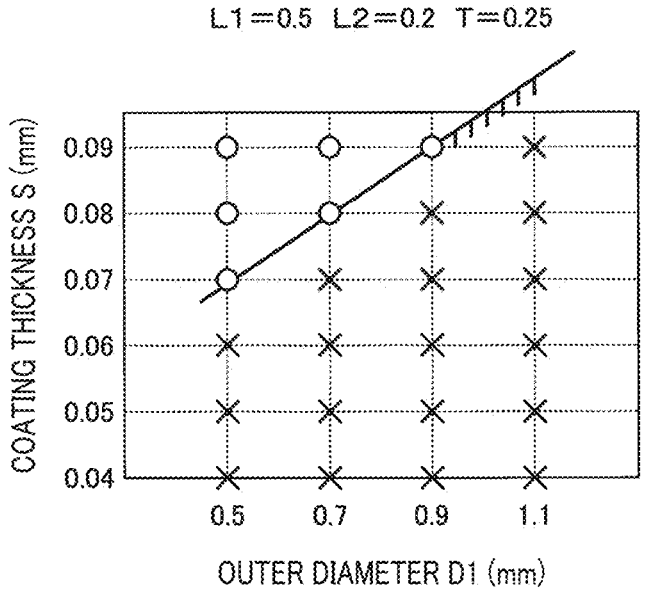

As shown in the upper and the lower parts of FIG. 9, also for the coating length L1 fixed at 0.5 mm, experimental examples 7 and 8 gave equivalent results. More specifically, the expressions of the boundary lines shown in this figure have indicated that the combinations satisfying the expression, $S \geq D1/20+0.045$ mm, caused no cracks irrespective of the coating thickness T of the discharge portion 521 and the exposed length L2 of the mount 511. The combinations satisfying the expression, $S<D1/20+0.045$ mm, caused cracks due to the thermal expansion of the core 51.

Figure 10:
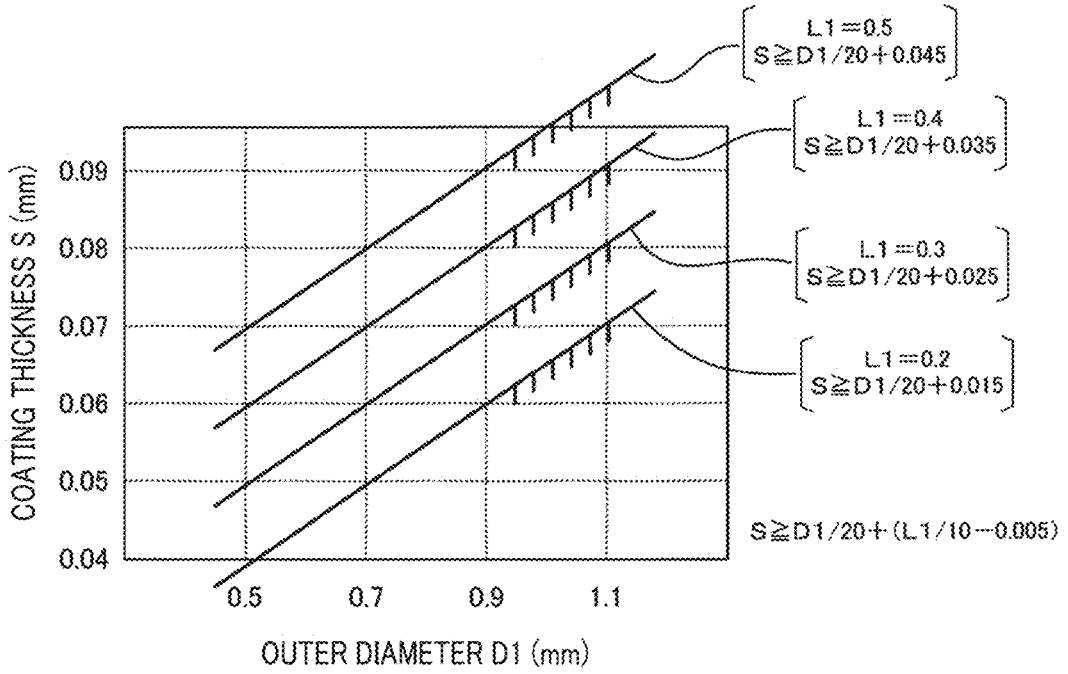
FIG. 10 shows relations observed in evaluation test 1 between the outer diameter D1 of the discharge portion and the coating thickness S of the side surface coating when the side surface coating has coating lengths L1 of 0.2 mm to 0.5 mm.

As shown in FIG. 10, in which the results from experimental examples 1 to 8 are summarized, the coating thickness S that can prevent cracks varies in accordance with the outer diameter D1 and the coating length L1 of the discharge portion 521. More specifically, for a fixed coating length L1, the sufficient coating thickness S is expressed as a linear function: $S \geq D1/20+\alpha$, where D1 has a coefficient of 1/20. The value of the constant term $\alpha$ is defined depending on L1. As L1 increases (e.g., within a range of 0.2 mm to 0.5 mm), $\alpha$ also increases (e.g., within a range of 0.005 mm to 0.045 mm) and the sufficient coating thickness S becomes greater.

This indicates that one factor in cracking is the outer diameter D1, i.e. the thermal stress generated on the interface between the core 51 and the side surface coating 522 and applied in the radial direction Y, and another factor in cracking is the coating length L1, i.e. the thermal stress generated on the interface between the core 51 and the side surface coating 522 and applied in the axial direction X. In other words, since the Ni—Cr—Fe based alloy forming the core 51 has a coefficient of linear expansion higher than the coefficient of linear expansion of the Pt—Rh alloy forming the surface layer 52, the thermal stress due to the difference in the coefficients of linear expansion is applied in both the radial direction Y and the axial direction X. When the coating thickness S is insufficient cracking in the side surface coating 522 due to the thermal expansion of the core 51 is occurred.

Thus, the coating thickness S is desirably determined as a sufficient value based on both the thermal stress applied in the radial direction Y due to the outer diameter D1 of the discharge portion 521 and the thermal stress applied in the axial direction X due to the coating length L1. More specifically, on the basis of the relation shown in FIG. 10, the sufficient coating thickness S can be represented as expression 1 using the outer diameter D1 and the coating length L1.

$$S \geq D1/20 + L1/10 - 0.005 \text{ mm} \qquad \text{Expression 1:}$$

By setting a sufficient coating thickness S so as to satisfy expression 1, the strength required for the thermal stress applied in both the radial direction Y and the axial direction X is improved, occurrence of cracking in the side surface coating 522 was prevented.

(Evaluation Test 2)

Next, the spark plug 1 according to the first embodiment was evaluated for the influence of varying diameters D2 of the smallest-diameter part of the mount 511 in the composite chip 5, upon the amount of wear on the discharge portion 521. Ni—Cr—Fe based alloy and Pt—Rh alloy, which were the same alloy materials as for the samples in evaluation test 1 described above, were respectively used as alloy materials constituting the core 51 and the surface layer 52.

Figure 11:
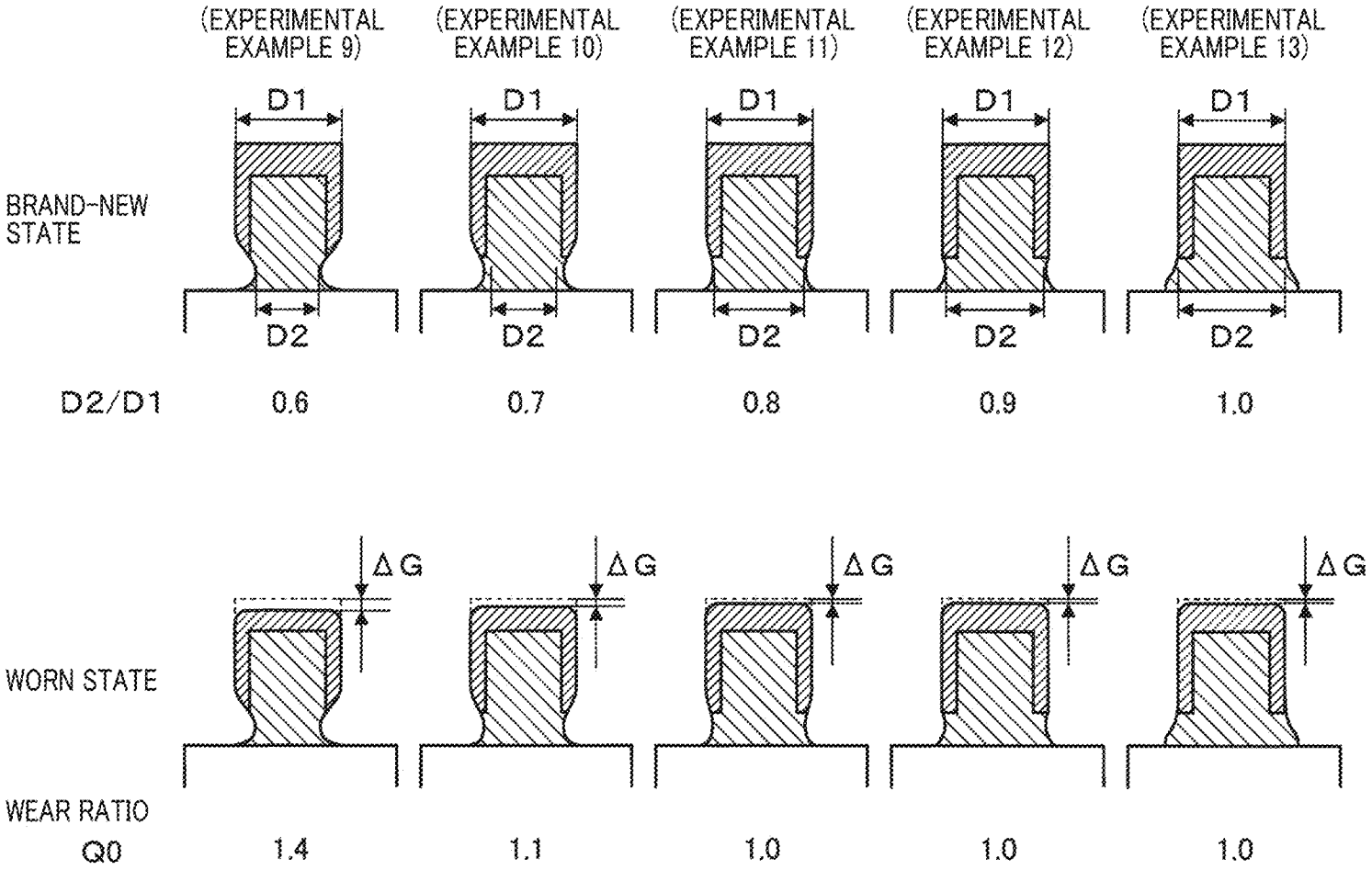
FIG. 11 illustrates shows the relation observed in evaluation test 2 between wear ratios and D2/D1 ratios which is ratios of diameters D2 of smallest-diameter parts in mounts to an outer diameter D1 of discharge portions in experimental examples 9 to 13, where the diameters D2 are varied.

As shown in FIG. 11, the samples in experimental examples 9 to 13 are composite chips 5 comprising their cores 51 and surface layers 52, which have the same dimensions except for the diameter D2 of the smallest-diameter part of each mount 511, and the diameter D2 of the smallest-diameter part was varied so that the ratio of the diameter D2 to the outer diameter D1 of the discharge portion 521 (D2/D1) was within a range of 0.6 to 1.0. The dimensions of each part were as follows:

The outer diameter D1 of the discharge portion 521: 0.7 mm

The coating thickness T of the discharge portion 521: 0.25 mm

The coating length L1 of the side surface coating 522: 0.4 mm

The coating thickness S of the side surface coating 522: 0.08 mm

The exposed length L2 of the mount 511: 0.2 mm

The diameter D2 of the smallest-diameter part of the mount 511: 0.42 mm to 0.7 mm In Evaluation test 2, the spark plug 1 provided with each composite chip 5 having the dimensions specified in each experimental example was installed in an engine cylinder, and the engine was operated under the conditions described below to calculate a wear ratio Q0 after a durability test.

Engine: Inline-four cylinder, 2,000 CC

Operating condition: 5,600 WOT

Operating time: 100 H

Figure 12:
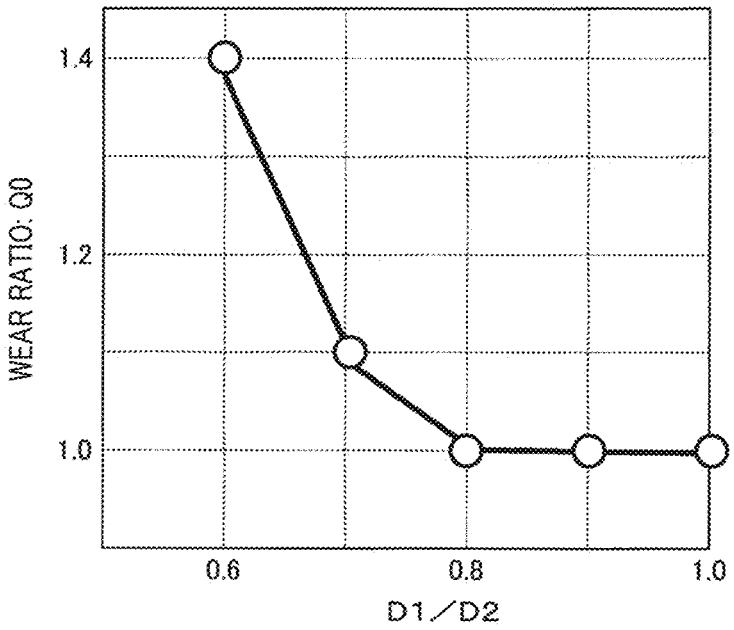
FIG. 12 shows the relation between the D2/D1 ratio and the wear ratio in evaluation test 2.

The amount of wear on each discharge portion 521 in worn state after the durability test illustrated in the lower part of FIG. 11 against that in brand new state before the durability test illustrated in the upper part of FIG. 11 is represented by ΔG. Letting the wear amount in experimental example 4 with D2/D1 of 1.0 be ΔG0, a ratio of the wear amount of ΔG in the sample in each experimental example is defined as wear ratio Q0=ΔG/ΔG0. For the sample in each experimental example, the value of D2/D1 in the brand new state and the calculated wear ratio Q0 are shown in the figure. In addition, the relation between them is shown in FIG. 12.

The results in FIG. 11 indicate that the wear ratio Q0 is 1.4 in experimental example 9 with D2/D1 of 0.6, but the wear ratio Q0 drops sharply as D2/D1 increases, then in experimental examples 11 to 13 with D2/D1 of 0.8 or more, each wear ratio Q0 is 1.0. In this manner, when the surface layers 52 of the composite chips 5 have the same shape, and the exposed lengths 12 of the mounts 511 are constant, the wear amount ΔG of a discharge portion 521 increases or decreases depending on the size of the smallest-diameter part of the mount 511. It can be assumed that when a smallest-diameter part have a smaller diameter D2, the thermal energy of the spark discharge P from the mount 511 cannot be sufficiently transferred into the electrode base material, and thus wear of the discharge portion 521 is promoted. As shown in FIG. 12, in which the results are summarized, as the diameter D2 of the smallest-diameter part increases, the wear on the discharge portion 521 is reduced, and this effect is substantially constant when D2/D1 is 0.8 or more.

Thus, to reduce wear on the discharge portion 521 of the surface layer 52, the composite chip 5 may be suitably formed so that D2/D1 is 0.8 or more. In this way, cracking in the side surface coating 522 caused by thermal stress is prevented, and wear on the discharge portion 52 caused by high temperature is suppressed, the wear resistance of the composite chip 5 is further improved, and the service life of the spark plug 1 is thus prolonged.

(Evaluation Test 3)

The spark plug 1 according to the first embodiment was evaluated for wear resistance by varying alloy materials constituting surface layers 52 of composite chips 5 and subjecting them to a temperature cycling test performed in the same manner as in evaluation test 1 described above. In each cycle of the temperature cycling test, the sample was heated to 1,050° C. and allowed to stand for six minutes, and then cooled to 150° C. and allowed to stand for six minutes. The appearance after 200 cycles was observed to evaluate its wear.

Figure 13:
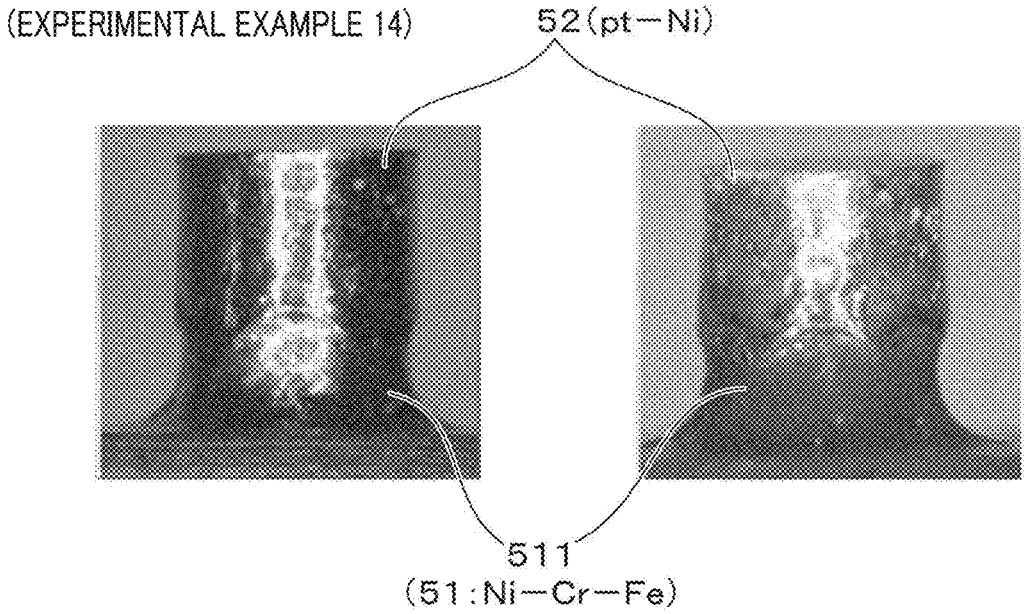
FIG. 13 is a photograph showing a change in a state of the metal surface observed in evaluation test 3 after a temperature cycling test in experimental example 14.

As shown in FIG. 13, in the sample in experimental example 14, Pt—Ni alloy (more specifically, 90% by mass of Pt and 10% by mass of Ni; coefficient of linear expansion: $11.4\times10^{-6}$/° C.) was used as a constituent material for the surface layer 52.

Ni—Cr—Fe based alloy (more specifically, 72% by mass of Ni, 17% by mass of Cr, and 10% by mass of Fe), which was the same material as for the samples in evaluation test 1 described above, was used as a constituent material for the core 51.

Figure 14:
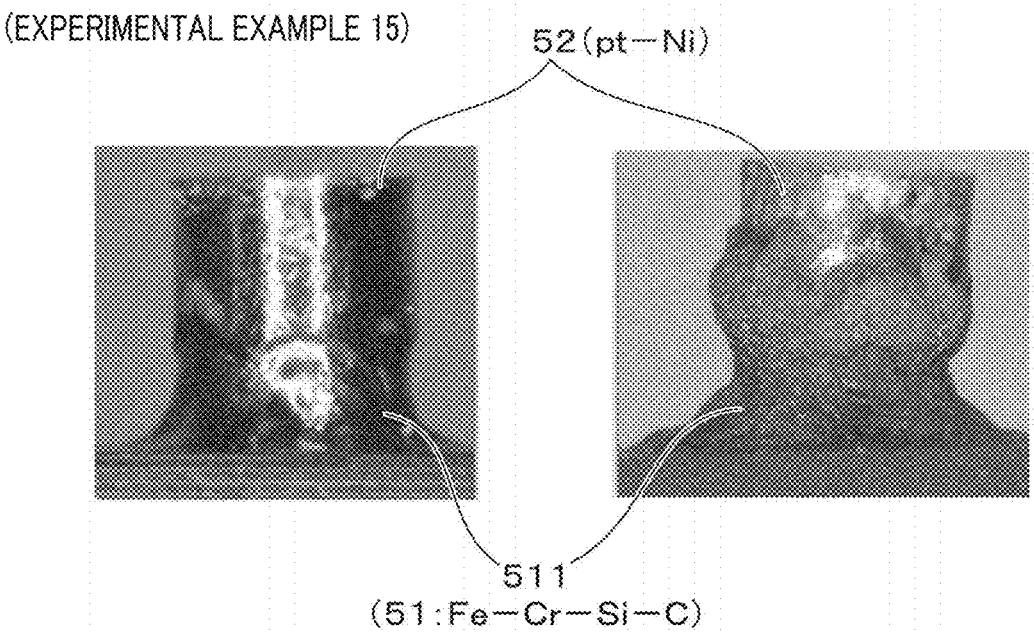
FIG. 14 is a photograph showing a change in a state of the metal surface observed in evaluation test 3 after a temperature cycling test in experimental example 15.

For comparison, the same temperature cycling test was performed on a sample in experimental example 15 shown in FIG. 14 while changing a constituting material of the core 51 to Fe based alloy (more specifically, 85Fe-11Cr-3Si-0.5C; coefficient of linear expansion: $13.2\times10^{-6}$/° C.). Pt—Ni alloy, which was the same material as for example 14, was used as a constituent material for the surface layer 52.

The dimensions of each part in both examples 14 and 15 were the same as in the samples in evaluation test 2 described above, and as follows:

The outer diameter D1 of the discharge portion 521: 0.7 mm

The coating thickness T of the discharge portion 521: 0.25 mm

The coating length L1 of the side surface coating 522: 0.4 mm

The coating thickness S of the side surface coating 522: 0.08 mm

The exposed length L2 of the mount 511: 0.2 mm

The diameter D2 of the smallest-diameter part of the mount 511: 0.6 mm

In experimental example 14, the appearance of the sample before the temperature cycles shown in the left part of FIG. 12 was compared with the appearance of the sample after the temperature cycles shown in the right part of FIG. 12. In the sample after the temperature cycles, although wear was observed on the surface layer 52 and the mount 511 which forms outer surface of the composite chip 5, the appearance changed little and exhibited good wear resistance.

In contrast, the sample in experimental example 15 was significantly changed from the appearance before the temperature cycles shown in the left part of FIG. 13 to the appearance after the temperature cycles shown in the right part of FIG. 13. The mount 511 bulged near the boundary area adjacent to the surface layer 52 through high temperature oxidation, and the mount 511 exposed from the surface layer 52 become heavily worn.

As shown in these results, by employing a Ni alloy material, which has good resistance to oxidation, for a constituting material of the core 51 high temperature oxidation can be reduced to improve wear resistance and the service life of the spark plug 1 can be prolonged.

Second Embodiment

A second embodiment of a spark plug for an internal combustion engine will now be described with reference to FIGS. 15 and 16.

Also, in this embodiment, a spark plug 1 and composite chips 5 formed on a center electrode 3 and a ground electrode 4 have the same basic structures as in the first embodiment, and thus their description will be omitted. In the present embodiment, as shown in FIG. 15, the core 51 has a different shape of outer periphery along an edge 53 of the composite chip 5, and the surface layer 52, covering the core 51, has a different shape of inner periphery. differences will now be mainly described.

Among reference signs used in the second and subsequent embodiments, the same reference signs as in a previous embodiment denote the same or corresponding components as in the previous embodiment, unless otherwise specified.

Figure 15:
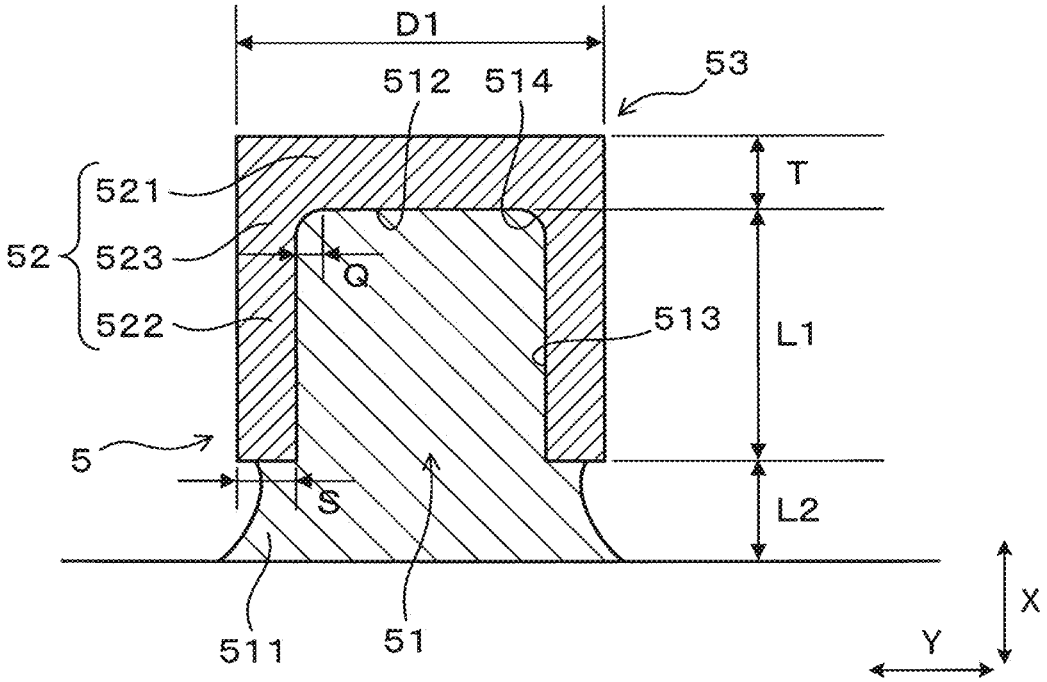
FIG. 15 is an enlarged cross-sectional view of a composite chip that forms a main part of a spark plug according to a second embodiment.

In FIG. 15, the core 51 is substantially columnar and has a chamfered area 514 having R chamfered shape along the connection area between a circular and flat protrusion end surface 512 and a cylindrical side surface 513. The surface layer 52, which covers the surface of the core 51 except for the mount 511, has the outer shape of a cup with a substantially constant diameter, and includes a discharge portion 521 covering the protrusion end surface 512 of the core 51, a side surface coating 522 covering the side surface 513, and a thick portion 523 adjacent to and covering the chamfered area 514.

In this arrangement of, the surface layer 52 has a coating thickness at the thick portion 523 covering the chamfered area 514 in the radial direction Y equal to or greater than the coating thickness S of the side surface coating 522 covering the side surface 513.

The thick portion 523 becomes thinner (the coating thickness decreasing in the radial direction Y) as it approaches the side surface 513 of the core 51, and becomes thicker as it approaches the protrusion end surface 512 of the core 51. The coating thicknesses have a maximum difference Q depending on the chamfered shape of the chamfered area 513.

Figure 16:
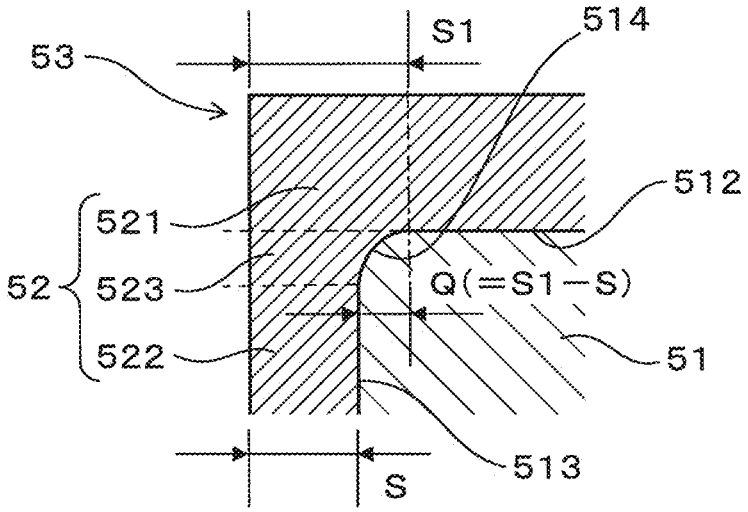
FIG. 16 is an enlarged cross-sectional view of a main part illustrating the edge of the composite chip according to the second embodiment.

In particular, as shown in FIG. 16, at the core 51, the connection area between the side surface 513 and the outer peripheral edge of the protrusion end surface 512 is R-chamfered to form the chamfered area 514 protruding outward and having outer circumference in a substantial quadrant arc shape. For the surface layer 52, the thick portion 523 coating the chamfered area 514 has an inward surface having a substantial quadrant arc shape corresponding to the chamfered area 514. The thick portion 523 has a maximum coating thickness S1 at the connecting area with the discharge portion 521, and the maximum coating thickness S1 is greater than the coating thickness S of the side surface coating 522. The thick portion 523 has the minimum thickness at the connecting area with the side surface coating 522, and the minimum thickness is equal to the coating thickness S of the side surface coating 522.

Thus, the maximum difference in the coating thickness Q in the radial direction Y (hereinafter sometimes referred to as the maximum difference in thickness) is the difference between the maximum coating thickness S1 of the thick portion 523 and the coating thickness S of the side surface coating, and represented by expression 3:

$$Q=S1-S \qquad \text{Expression 3:}$$

Also, in this configuration, the relation between the outer diameter D1 of the discharge portion 521, and the coating thickness S and the coating length L1 of the side surface coating 522 may be set in a manner to satisfy expression 1 described above. Suitably, it is desirable to satisfy the relation of expression 1A below, which is established by adding the term expressing the maximum difference in thickness Q to expression 1. Expression 1A is derived from evaluation test 4 described later.

$$S \geq D1/20+L1/10-Q/10-0.005 \text{ mm} \qquad \text{Expression 1A:}$$

The maximum difference in thickness Q may be determined as appropriate within a range of, for example, 0 mm<Q≤0.25 mm.

Figure 17:
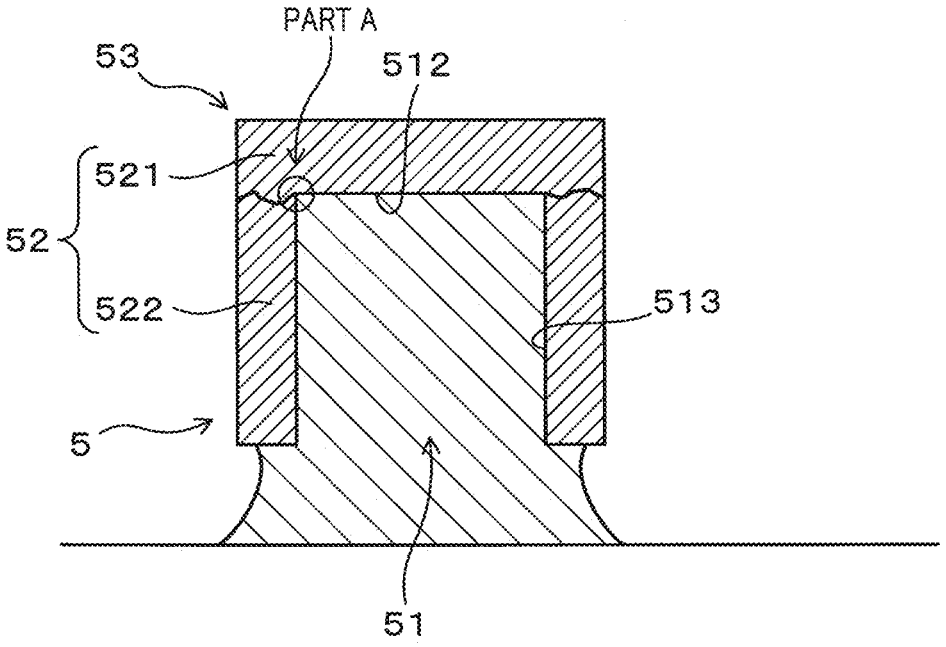
FIG. 17 is an enlarged cross-sectional view schematically showing an example of a crack observed in evaluation test 3 that run in a surface layer of the composite chip.

As shown in FIG. 17, the results of the durability test in the first embodiment have revealed that, when the chamfered area 514 of the core 51 is not formed, cracking in the surface layer 52 become likely to occur from the inner periphery of the edge 53 indicated by part A in the figure as a staring point. Thus, to improve the strength of an area corresponding to part A, the thick portion 523 is formed in the connection area between the discharge portion 521 and the side surface coating 522. More specifically, the chamfered area 514 is formed in the connection area, corresponding to the thick portion 523, between the side surface 513 and the protrusion end surface 512 of the core 51, and coated with the cup-shaped surface layer 52. In this manner, the thick portion 523 adjacent to the chamfered area 514 can be formed to reduce stress concentration and improve the strength.

Figure 18:
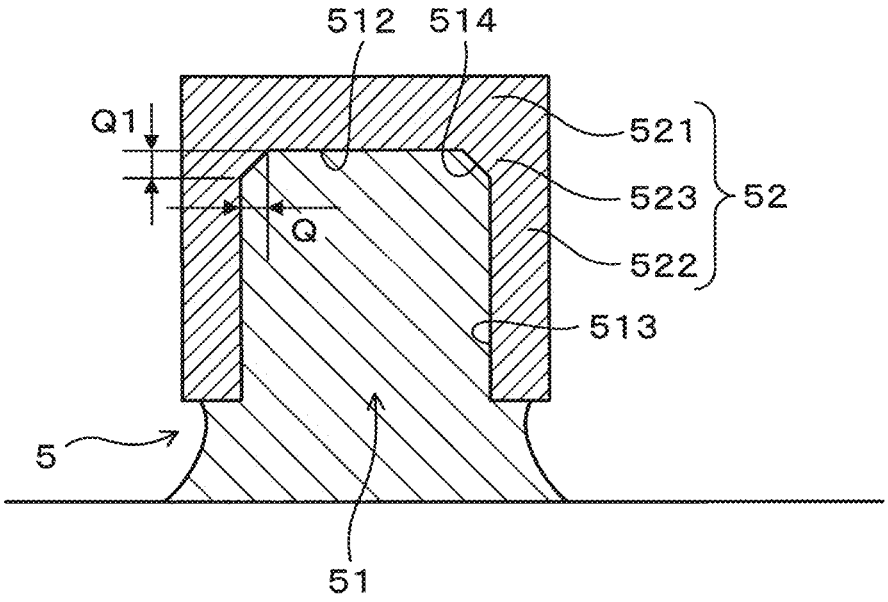
FIG. 18 is an enlarged cross-sectional view of a composite chip that forms a main part of a spark plug according to a modification example of the second embodiment.

As shown in FIG. 18 as a modification example, the chamfered area 514 of the core 51 may be C-chamfered, not R-chamfered. In this case, the outer peripheral surface to be the chamfered area 514 is C-chamfered into a flat surface sloping from the outer peripheral edge of the protrusion end surface 512 down to the side surface 513. The inner peripheral surface of the thick portion 523 covering the chamfered area 514 is also a sloped flat surface corresponding to the chamfered area 514.

Also, in this configuration, the surface layer 52 has a maximum coating thickness S1 in the radial direction Y at the connection area between the thick portion 523 and the discharge portion 521. By setting each part in a manner to satisfy expression 3 described above for the maximum difference in thickness Q (=S1−S), stress concentration can similarly be reduced and improve the strength can be improved.

The maximum difference in thickness Q corresponds to the chamfer length of the chamfered area 514 in the radial direction Y.

The chamfered area 514 may have any slope angle. For example, at 45°, the thick portion 523 has a length Q1 in the axial direction X equal to the maximum difference in thickness Q. At a slope angle greater than 45°, the thick portion 523 has a length Q1 in the axial direction X smaller than the maximum difference in thickness Q.

(Evaluation Test 4)

Next, the spark plug 1 according to the second embodiment was evaluated for the occurrence of cracks in the side surface coating 522 with varying outer diameters D1 of the discharge portion 521 of the composite chip 5, varying coating thicknesses S and coating lengths L1 of the side surface coating 522, and further varying maximum differences in thickness Q at the thick portion 523.

As shown in FIGS. 19 to 24, different samples with different dimensions were prepared for experimental examples 16 to 27. Each of the samples was subjected to a temperature cycling test in the same manner as in evaluation test 1 described above, and the results were compared. In experimental examples 16, 18, and 20, the maximum difference in thickness Q was 0 mm. In other words, configurations in these experimental examples corresponded to those in the first embodiment.

In experimental examples 16 to 27, the mount 511 of the core 51 had an exposed length L2 fixed at 0.2 mm, and the discharge portion 521 of the surface layer 52 had a coating thickness T fixed at 0.15 mm. Ni—Cr—Fe based alloy and Pt—Rh alloy, which were the same alloy materials as for the samples in evaluation test 1 described above, are respectively used for the core 51 and the surface layer 52.

Figure 19:
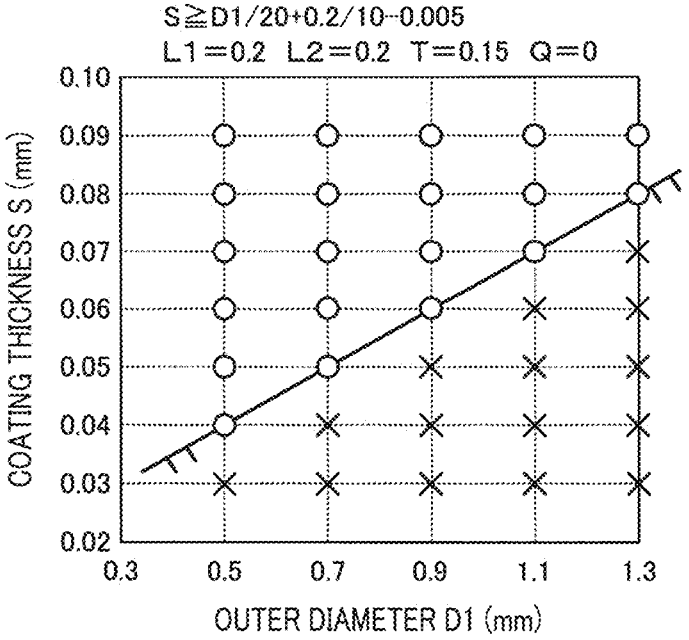
FIG. 19 shows relations observed in evaluation test 4 between the outer diameter D1 of the discharge portion and the coating thickness S of the side surface coating in experimental examples 16 and 17 (more specifically, coating length L1: 0.2 mm, maximum differences in thickness Q: 0 mm and 0.05 mm)
Figure 19:
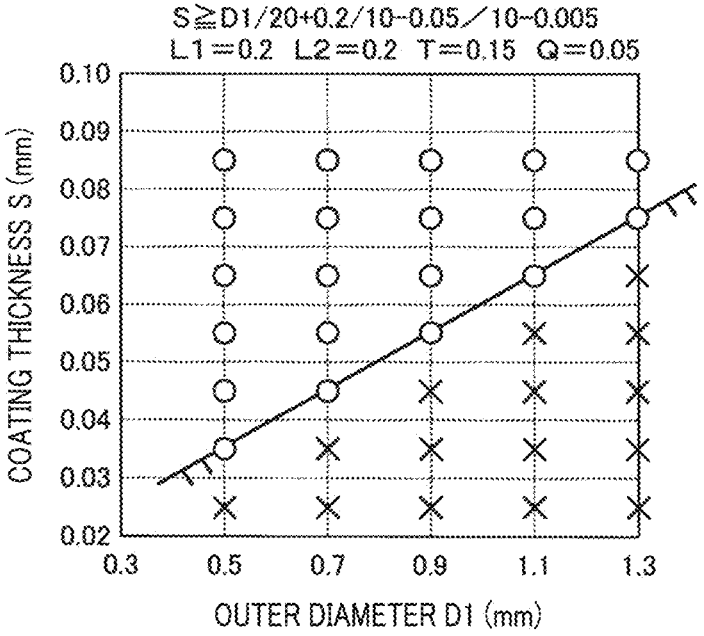

In experimental examples 16 and 17 shown in FIG. 19, the coating length L1 was fixed at 0.2 mm, while the coating thickness S was varied in increments of 0.01 mm within a range of 0.03 mm to 0.09 mm, and the outer diameter D1 of the discharge portion 521 was varied in increments of 0.2 mm within a range of 0.5 mm to 1.3 mm. In experimental example 16, the maximum difference in thickness Q was 0 mm, and in experimental example 17, the maximum difference in thickness Q was 0.05 mm. Then, the relation between the thick portion 523 and the appearance of cracks was assessed.

As shown in the upper and the lower parts of FIG. 19, it has revealed that, with the same outer diameter D1, the lower limit of the coating thickness S that gives good results (○), i.e. no cracks, is smaller in experimental example 17 with the thick portion 523 compared to the comparison between experimental example 16 without the thick portion 523.

More specifically, the expressions of the boundary lines shown in this figure have indicated that in experimental example 16, the combinations satisfying the expression, S≥D1/20+0.2/10−0.005 mm, caused no cracks, while in experimental example 17, the combinations satisfying the expression, S≥D1/20+0.2/10−0.05/10−0.005 mm, caused no cracks. Each of the combinations that did not satisfy the expressions caused cracks due to the thermal expansion of the core 51.

Figure 20:
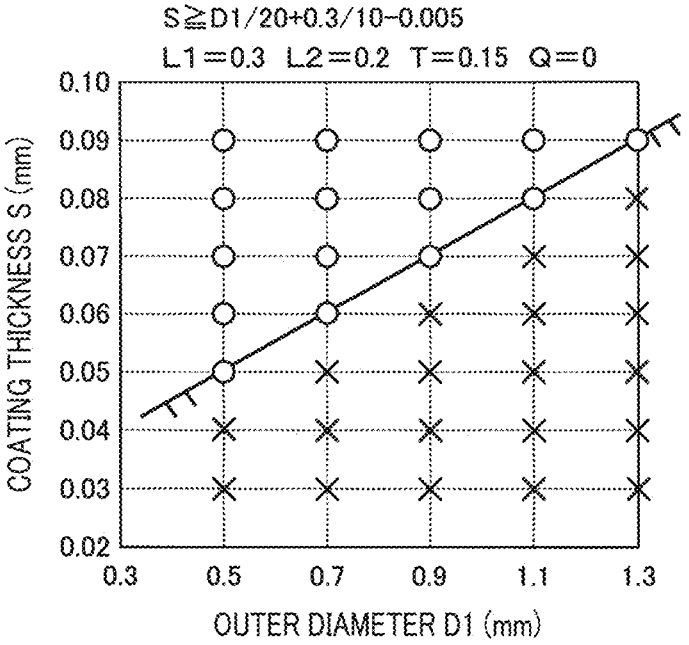
FIG. 20 shows relations observed in evaluation test 4 between the outer diameter D1 of the discharge portion and the coating thickness S of the side surface coating in experimental examples 18 and 19 (more specifically, coating length L1: 0.3 mm, maximum differences in thickness Q: 0 mm and 0.05 mm)
Figure 20:
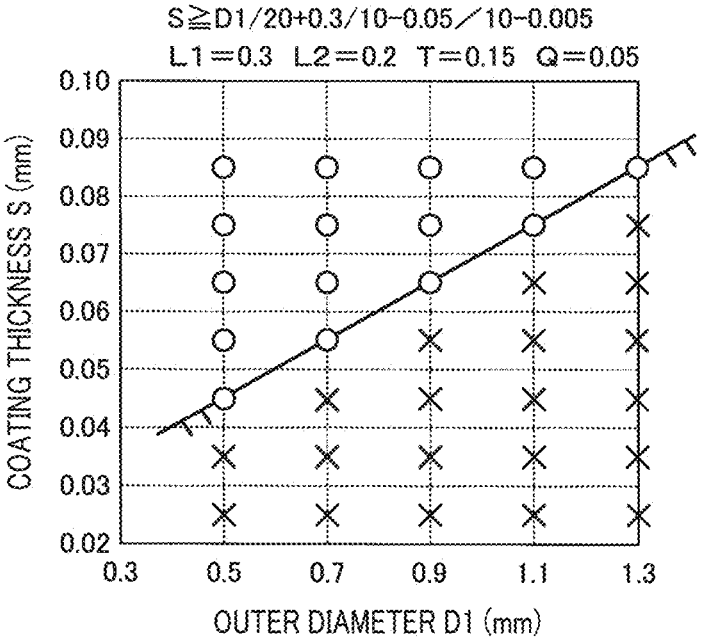

In experimental examples 18 and 19 shown in FIG. 20, the temperature cycling test was performed in the same manner as in experimental examples 16 and 17 except that the coating length L1 was fixed at 0.3 mm. In experimental examples 20 and 21 shown in FIG. 21, the temperature cycling test was performed in the same manner as in experimental examples 16 and 17 except that the coating length L1 was fixed at 0.5 mm. The test results are shown in the figures.

Figure 21:
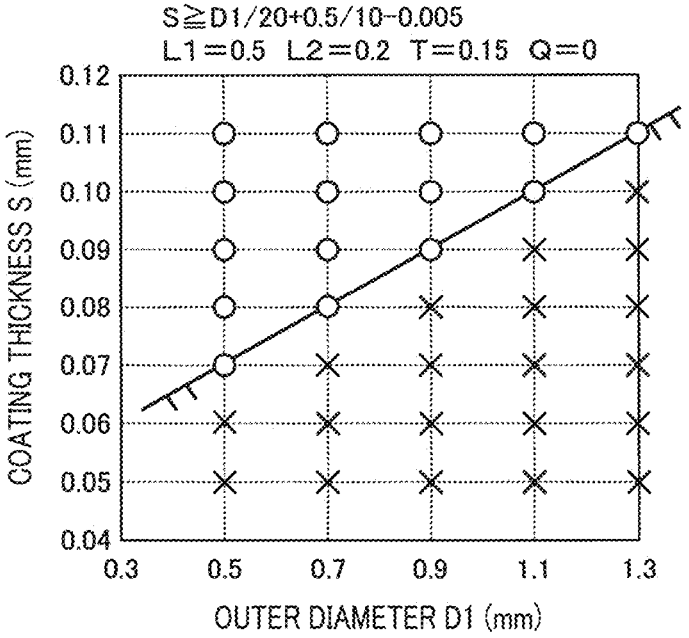
FIG. 21 shows relations observed in evaluation test 4 between the outer diameter D1 of the discharge portion and the coating thickness S of the side surface coating in experimental examples 20 and 21 (more specifically, coating length L1: 0.5 mm, maximum differences in thickness Q: 0 mm and 0.05 mm)
Figure 21:
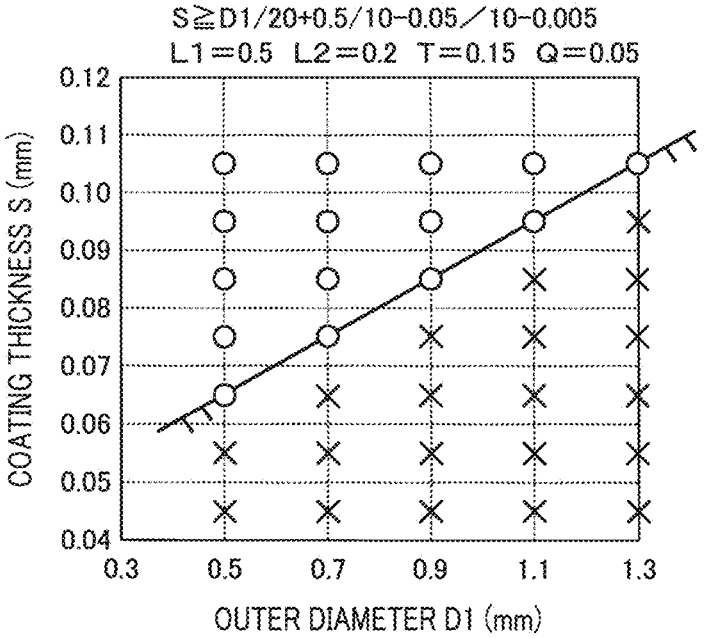

As shown in the upper and the lower parts of FIGS. 20 and 21, experimental examples 19 and 21 with the thick portion 523 has given similar results compared to experimental examples 18 and 20 without the thick portion 523.

More specifically, the expressions of the boundary lines shown in each figure have indicated that in experimental example 18, the combinations satisfying the expression, S≥D1/20+0.3/10−0.005 mm, caused no cracks, while in experimental example 19, the combinations satisfying the expression, S≥D1/20+0.3/10−0.05/10−0.005 mm, caused no cracks. In experimental example 20, the combinations satisfying the expression, S≥D1/20+0.5/10−0.005 mm, caused no cracks. In experimental example 21, the combinations satisfying the expression, S≥D1/20+0.5/10−0.05/10−0.005 mm, caused no cracks. Each of the combinations that did not satisfy the expressions caused cracks due to the thermal expansion of the core 51.

These results have indicated that, with the coating length L1 being constant, the coating thickness S sufficient to prevent cracking becomes greater with increasing outer diameter D1, while the reduction of the term of the maximum difference in thickness Q shifts the expressions of the boundary lines in the direction in which the value of the coating thickness S decreases. That is, the formation of the thick portion 523 can reduce the coating thickness S required to prevent cracking.

Furthermore, in experimental examples 22 to 27, the relation between the thick portion 523 and the appearance of cracks was assessed with different maximum differences in thickness Q.

Figure 22:
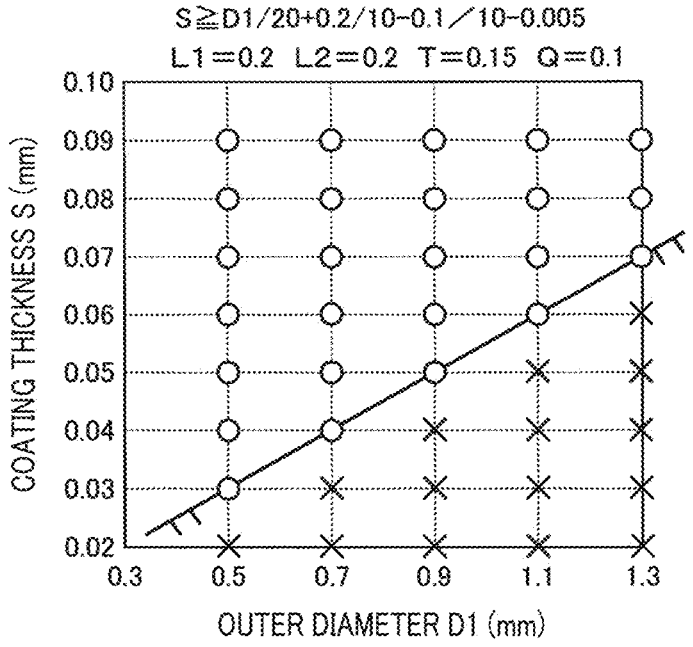
FIG. 22 shows relations observed in evaluation test 4 between the outer diameter D1 of the discharge portion and the coating thickness S of the side surface coating in experimental examples 22 and 23 (more specifically, coating length L1: 0.2 mm, maximum differences in thickness Q: 0.1 mm and 0.25 mm)
Figure 22:
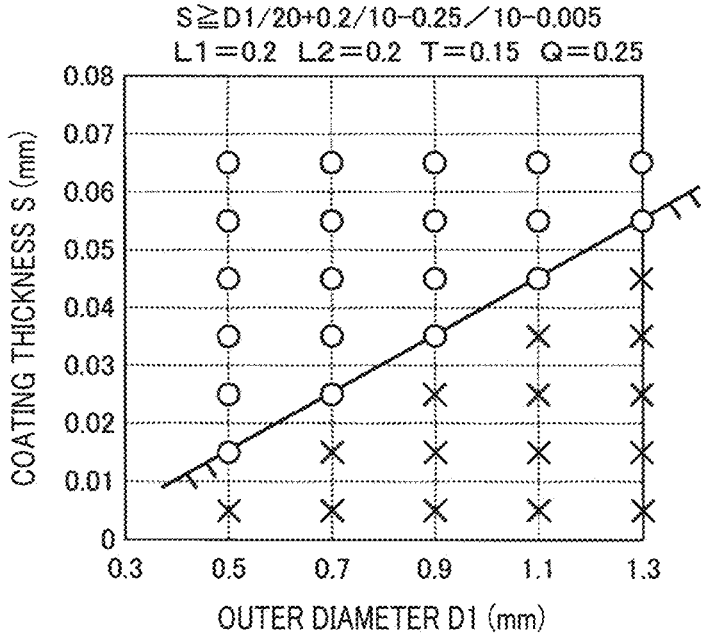

In experimental examples 22 and 23 shown in FIG. 22, the coating length L1 was fixed at 0.2 mm. In experimental example 22, the maximum difference in thickness Q was 0.1 mm, and in experimental example 23, the maximum difference in thickness Q was 0.25 mm. With these dimensions, the same temperature cycling test was performed. In experimental examples 24 and 25 shown in FIG. 23, the coating length L1 was fixed at 0.3 mm. In experimental example 24, the maximum difference in thickness Q was 0.1 mm, and in experimental example 24, the maximum difference in thickness Q was 0.25 mm. With these dimensions, the same temperature cycling test was performed. Additionally, in experimental examples 26 and 27 shown in FIG. 24, the coating length L1 was fixed at 0.5 mm. In experimental example 26, the maximum difference in thickness Q was 0.1 mm, and in experimental example 27, the maximum difference in thickness Q was 0.25 mm. With these dimensions, the same temperature cycling test was performed. The results are shown in the figures.

Figure 23:
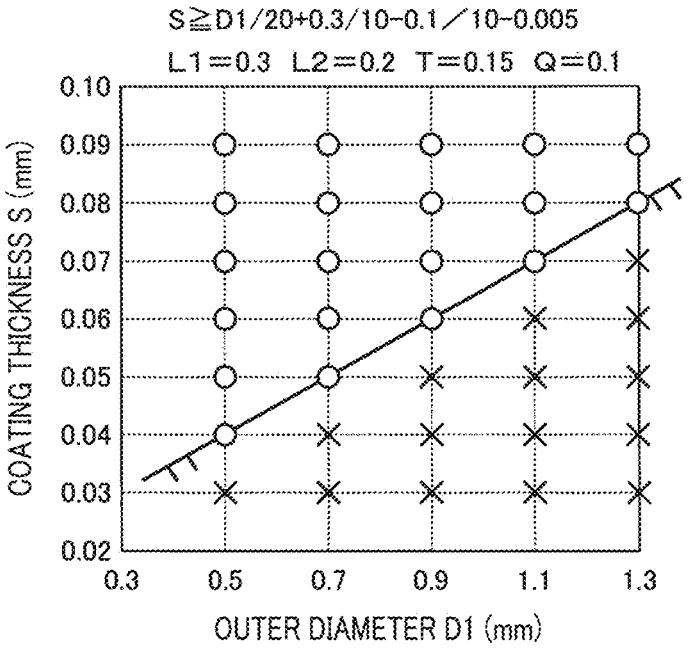
FIG. 23 shows relations observed in evaluation test 4 between the outer diameter D1 of the discharge portion and the coating thickness S of the side surface coating in experimental examples 24 and 25 (more specifically, coating length L1: 0.3 mm, maximum differences in thickness Q: 0.1 mm and 0.25 mm)
Figure 23:
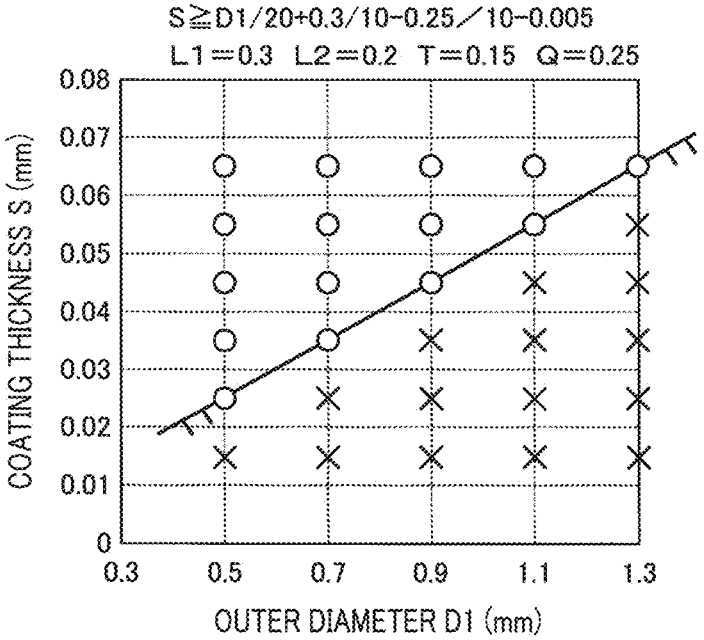
Figure 24:
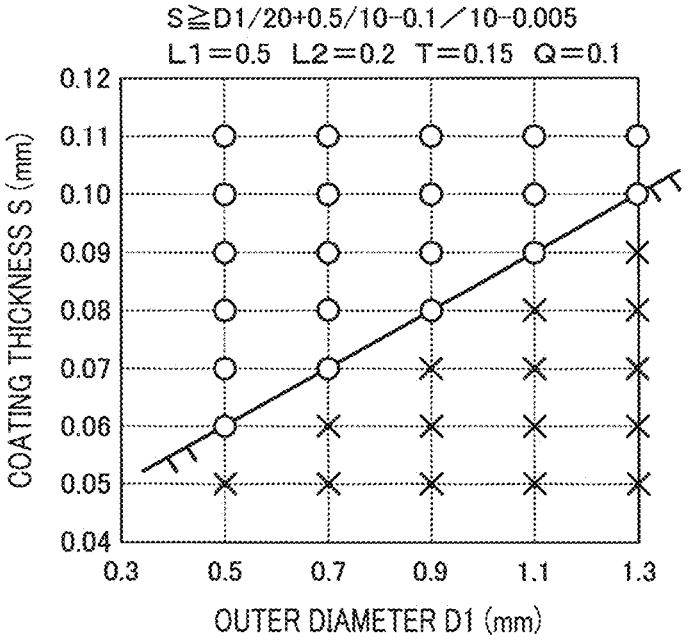
FIG. 24 shows relations observed in evaluation test 4 between the outer diameter D1 of the discharge portion and the coating thickness S of the side surface coating in experimental examples 26 and 27 (more specifically, coating length L1: 0.5 mm, maximum differences in thickness Q: 0.1 mm and 0.25 mm).
Figure 24:
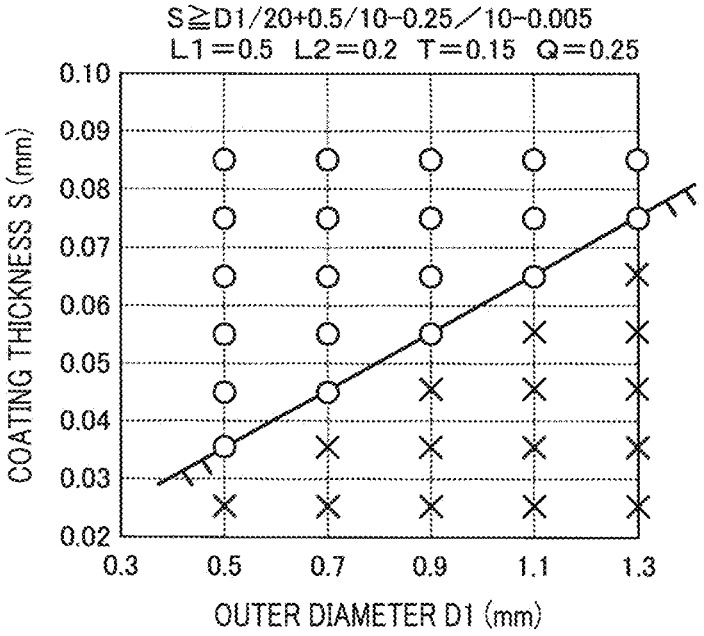

As shown in the upper and the lower parts of FIGS. 22 to 24, in experimental examples 22, 24, and 26 in which the thick portion 523 had the maximum difference in thickness Q of 0.1 mm, the expressions of the shown boundary lines shifted in the direction in which the value of the coating thickness S decreases compared to experimental examples 23, 25, and 27 in which the thick portion 523 had the maximum difference in thickness Q of 0.25 mm.

More specifically, the combinations that cause no cracks are obtained from the following expressions of the boundary lines shown in the figures.

$S \geq D1/20+0.2/10-0.1/10-0.005$ mm — Experimental example 22:

$S \geq D1/20+0.2/10-0.25/10-0.005$ mm — Experimental example 23:

$S \geq D1/20+0.3/10-0.1/10-0.005$ mm — Experimental example 24:

$S \geq D1/20+0.3/10-0.25/10-0.005$ mm — Experimental example 25:

$S \geq D1/20+0.5/10-0.1/10-0.005$ mm — Experimental example 26:

$S \geq D1/20+0.5/10-0.25/10-0.005$ mm — Experimental example 27:

Based on the relation of these expressions, the coating length L1 and the maximum difference in thickness Q can be used to establish expression 1A.

$S \geq D1/20+L1/10-Q/10-0.005$ mm — Expression 1A:

Then, by setting the coating thickness S so as to satisfy expression 1A in accordance with the maximum difference in thickness Q, improvement of the strength required against the thermal stress applied in both the radial direction Y and the axial direction X can be achieved, suppressing the occurrence of cracking in the side surface coating 522.

In the above embodiments, although the composite chips 5 are installed on both the center electrode 3 and the ground electrode 4 of the spark plug 1, a composite chip 5 may be installed on at least one of the center electrode 3 and the ground electrode 4.

The present disclosure is not limited to the embodiments described above, but applicable to various embodiments without departing from the gist thereof. For example, in the above embodiments, the spark plug 1 is described as being installed in a lean burn engine, but it may be applied to any internal combustion engine other than a lean burn engine. The components of the spark plug 1 may also be changed as appropriate from those shown in FIG. 3.

What is claimed is:

1. A spark plug for an internal combustion engine, comprising:

a center electrode held inside a cylindrical insulator and protruding from a tip of the insulator toward a distal end;

a ground electrode provided on a distal end of a housing holding the insulator, the ground electrode facing the center electrode in an axial direction; and a composite chip formed on at least one of the center electrode and the ground electrode and protruding in the axial direction, wherein the composite chip includes a core having a mount formed integrally with an electrode base material, and a cup-shaped surface layer having a discharge portion covering a protrusion end surface of the core and a side surface coating covering a side surface continuous to the protrusion end surface, the surface layer includes a thick portion along a connection area between the discharge portion and the side surface coating, the thick portion having, in the radial direction, a maximum coating thickness S1 greater than the coating thickness S of the side surface coating, the core is formed from a Ni alloy material, and the surface layer is formed from a Pt alloy material, and in the surface layer, a coating thickness S of the side surface coating in a radial direction, an outer diameter D1 of the discharge portion, and a coating length L1 of the side surface coating in the axial direction satisfy a relation represented by expression 1:

$S \geq D1/20+L1/10-0.005$ mm; and — Expression 1:

the coating thickness S of the side surface coating, the outer diameter D1 of the discharge portion, the coating length L1 of the side surface coating in the axial direction, and a coating thickness maximum difference Q being a difference between the maximum coating thickness S1 and the coating thickness S of the side surface coating satisfy a relation represented by expression 1A:

$S \geq D1/20+L1/10-Q/10-0.005$ mm — Expression 1A.

2. The spark plug for the internal combustion engine according to claim 1, wherein the core includes a chamfered area along a connection area between the protrusion end surface and the side surface, the thick portion is adjacent to the chamfered area in the radial direction, and the coating thickness maximum difference Q is within a range of 0 mm<Q≤0.25 mm.

3. The spark plug for the internal combustion engine according to claim 1, wherein the Pt alloy material for the surface layer is Pt—Rh alloy, Pt—Ni alloy, Pt—Ir alloy, or Pt—Pd alloy.

4. The spark plug for the internal combustion engine according to claim 1, wherein the Ni alloy material for the core is Ni—Cr based alloy or Ni—Cr—Fe based alloy.

5. The spark plug for the internal combustion engine according to claim 1, wherein the mount exposed from the side surface coating has a smallest-diameter part with a diameter D2, and the diameter D2 and the outer diameter D1 of the discharge portion satisfy a relation represented by expression 2:

$D2/D1 \geq 0.8$ — Expression 2.

6. The spark plug for the internal combustion engine according to claim 1, wherein in the axial direction, the side surface coating has a coating length L1 within a range of 0.2 mm≤L1≤0.5 mm, and the mount exposed from the side surface coating has an exposed length L2 within a range of 0.2 mm≤L2≤0.5 mm.

7. The spark plug for the internal combustion engine according to claim 1, wherein the discharge portion has an outer diameter D1 within a range of 0.5 mm≤D1≤1.1 mm, and the discharge portion has a coating thickness T in the axial direction within a range of 0.15 mm≤T≤0.25 mm.

8. The spark plug for the internal combustion engine according to claim 1, wherein the coating thickness S of the side surface coating and the coating thickness T of the discharge portion have a relation of S≤T.

9. The spark plug for the internal combustion engine according to claim 1, wherein the mount is joined to the electrode base material and formed from Ni alloy or Ni alloy containing noble metal.

* * * * *